US007815514B2

(12) United States Patent
Henry et al.

(10) Patent No.: US 7,815,514 B2
(45) Date of Patent: Oct. 19, 2010

(54) WATER AMUSEMENT PARK CONVEYOR BARRIERS

(75) Inventors: Jeffrey Wayne Henry, New Braunfels, TX (US); John Timothy Schooley, Houston, TX (US)

(73) Assignee: Water Ride Concepts, Inc., New Braunfels, TX (US)

( * ) Notice: Subject to any disclaimer, the term of this patent is extended or adjusted under 35 U.S.C. 154(b) by 0 days.

(21) Appl. No.: 11/215,736

(22) Filed: Aug. 30, 2005

(65) Prior Publication Data

US 2007/0049385 A1 Mar. 1, 2007

(51) Int. Cl.
*A63G 31/00* (2006.01)
*A63G 21/00* (2006.01)

(52) U.S. Cl. ..... 472/128; 472/13

(58) Field of Classification Search ..... 472/116, 472/117, 128, 129, 3, 13; 104/53, 69, 70
See application file for complete search history.

(56) References Cited

U.S. PATENT DOCUMENTS

| | | | |
|---|---|---|---|
| 193,516 | A | 7/1877 | Johns |
| 419,860 | A | 1/1890 | Libbey |
| 435,227 | A | 8/1890 | Inglis |
| 485,624 | A | 11/1892 | Gardner |
| 536,441 | A | 3/1895 | Morris |
| 540,715 | A | 6/1895 | Butler |
| 548,256 | A | 10/1895 | Idler |
| 552,713 | A | 1/1896 | Lenox |
| 555,049 | A | 2/1896 | Ogilbe |
| 566,182 | A | 8/1896 | Jackman |
| 570,016 | A | 10/1896 | Harman |
| 572,426 | A | 12/1896 | Idler |
| 576,704 | A | 2/1897 | Urch |

(Continued)

FOREIGN PATENT DOCUMENTS

| | | |
|---|---|---|
| BE | 543055 | 12/1955 |

(Continued)

OTHER PUBLICATIONS

International Search Report for PCT/US01/28535 mailed Mar. 27, 2002.

(Continued)

*Primary Examiner*—Kien T Nguyen
(74) *Attorney, Agent, or Firm*—Meyertons, Hood, Kivlin, Kowert & Goetzel, P.C.; Eric B. Meyertons

(57) ABSTRACT

An amusement ride system and method are described. In some embodiments, an amusement ride system may be generally related to water amusement attractions and rides. Further, the disclosure generally relates to water-powered rides and to a system and method in which participants may be more involved in a water attraction. An amusement ride system may include a system for conveying a participant from a first source of water to a second source of water. A system for conveying a participant from a first source of water to a second source of water may include a belt and a belt movement system. A system for conveying a participant from a first source of water to a second source of water may include one or more barriers configured to inhibit participants from leaving the belt as the participants are conveyed along the belt.

15 Claims, 17 Drawing Sheets

U.S. PATENT DOCUMENTS

| | | | |
|---|---|---|---|
| 583,121 | A | 5/1897 | Pattee |
| 604,164 | A | 5/1898 | Wilde et al. |
| 610,548 | A | 9/1898 | Manny |
| 640,439 | A | 1/1900 | Boyton |
| 654,980 | A | 7/1900 | Howard |
| 664,179 | A | 12/1900 | Schofield |
| 665,765 | A | 1/1901 | Thompson |
| 689,114 | A | 12/1901 | Pape |
| 691,353 | A | 1/1902 | Carpenter et al. |
| 697,202 | A | 4/1902 | Donne |
| 697,891 | A | 4/1902 | Schrader |
| 714,717 | A | 12/1902 | LaPorte |
| 720,014 | A | 2/1903 | Folks |
| 724,040 | A | 3/1903 | Pusterla |
| 724,757 | A | 4/1903 | Symonds |
| 728,303 | A | 5/1903 | Roltair |
| 728,894 | A | 5/1903 | Folks |
| 741,964 | A | 10/1903 | Harlan |
| 743,968 | A | 11/1903 | Wilson |
| 744,880 | A | 11/1903 | Smith |
| 753,311 | A | 3/1904 | Pusterla |
| 753,449 | A | 3/1904 | Thompson |
| 754,698 | A | 3/1904 | Reed |
| 757,286 | A | 4/1904 | Du Clos |
| 760,503 | A | 5/1904 | Welsh |
| 762,566 | A | 6/1904 | Webster et al. |
| 764,675 | A | 7/1904 | Pfeiffer |
| 774,209 | A | 11/1904 | Stubbs |
| 774,274 | A | 11/1904 | Pusterla |
| 774,917 | A | 11/1904 | Maguire |
| 776,936 | A | 12/1904 | Pusterla |
| 779,464 | A | 1/1905 | Bruce |
| 783,425 | A | 2/1905 | Folks |
| 792,422 | A | 6/1905 | Kelly |
| 801,945 | A | 10/1905 | Welsh |
| 808,487 | A | 12/1905 | Stahl |
| 824,436 | A | 6/1906 | Pester |
| 828,689 | A | 8/1906 | Thompson |
| 831,149 | A | 9/1906 | Faller |
| 849,970 | A | 4/1907 | Boyton |
| 868,736 | A | 10/1907 | Washington |
| 879,283 | A | 2/1908 | Mayberry et al. |
| 883,441 | A | 3/1908 | Andrews |
| 891,388 | A | 6/1908 | Visser et al. |
| 896,940 | A | 8/1908 | Rosen |
| 904,848 | A | 11/1908 | DeVore |
| 929,972 | A | 8/1909 | M'Giehan |
| 931,863 | A | 8/1909 | Haight |
| 952,673 | A | 3/1910 | Karr |
| 1,004,174 | A | 9/1911 | Kavakos |
| 1,056,929 | A | 3/1913 | Navarro |
| 1,062,838 | A | 5/1913 | Miller |
| 1,063,949 | A | 6/1913 | Bedient |
| 1,095,965 | A | 5/1914 | Glazier |
| 1,124,950 | A | 1/1915 | Reagen et al. |
| 1,158,295 | A | 10/1915 | Rodriguez |
| 1,159,519 | A | 11/1915 | Menier |
| 1,167,993 | A | 1/1916 | Guzendorfer |
| 1,195,707 | A | 8/1916 | Miller |
| 1,198,749 | A | 9/1916 | Myers |
| 1,230,559 | A | 6/1917 | Burke |
| 1,249,455 | A | 12/1917 | Myers |
| 1,320,124 | A | 10/1919 | Chrul |
| 1,378,635 | A | 5/1921 | Unger |
| 1,399,469 | A | 12/1921 | Cucullu |
| 1,417,570 | A | 5/1922 | Ridgway |
| 1,440,661 | A | 1/1923 | Dickinson |
| 1,441,126 | A | 1/1923 | Sherman et al. |
| 1,448,306 | A | 3/1923 | Lezert |
| 1,497,754 | A | 6/1924 | Howard |
| 1,520,217 | A | 12/1924 | Auperl |
| 1,540,635 | A | 6/1925 | Kohl |
| 1,551,249 | A | 8/1925 | Held |
| 1,563,855 | A | 12/1925 | Held |
| 1,591,566 | A | 7/1926 | Schmidt et al. |
| 1,601,483 | A | 9/1926 | Vaszin |
| 1,606,024 | A | 11/1926 | Gorhum et al. |
| 1,606,854 | A | 11/1926 | Vaszin |
| 1,607,771 | A | 11/1926 | Miller |
| 1,609,922 | A | 12/1926 | Wiig |
| 1,648,196 | A | 11/1927 | Rohmer |
| 1,763,976 | A | 6/1930 | Lippincott |
| 1,783,268 | A | 12/1930 | Traver |
| 1,849,226 | A | 3/1932 | Erban |
| 1,859,267 | A | 5/1932 | Kurz |
| 1,893,167 | A | 1/1933 | Glagolin |
| 1,926,780 | A | 9/1933 | Lippincott |
| 2,064,035 | A | 12/1936 | Rynearson |
| 2,146,631 | A | 2/1939 | Kish |
| 2,484,466 | A | 10/1949 | Rumler |
| 2,705,144 | A * | 3/1955 | Ridgway ..... 472/49 |
| 2,738,885 | A | 3/1956 | Demaline |
| 2,888,205 | A | 5/1959 | Trucco |
| D190,127 | S | 4/1961 | Fowler |
| 2,991,726 | A | 7/1961 | Miller |
| 3,000,017 | A | 9/1961 | Skovira |
| 3,003,430 | A | 10/1961 | Hamel |
| 3,030,895 | A | 4/1962 | Hamel |
| 3,113,528 | A | 12/1963 | Morgan et al. |
| 3,114,333 | A | 12/1963 | Fowler et al. |
| 3,116,925 | A | 1/1964 | Welch |
| D204,282 | S | 4/1966 | Morgan |
| 3,302,413 | A | 2/1967 | Burnett |
| 3,390,640 | A | 7/1968 | Couttet et al. |
| 3,404,635 | A | 10/1968 | Bacon et al. |
| 3,456,943 | A | 7/1969 | Brown |
| 3,473,334 | A | 10/1969 | Dexter |
| 3,508,405 | A | 4/1970 | Koch |
| 3,534,413 | A | 10/1970 | Plasseraud |
| 3,598,402 | A | 8/1971 | Frenzl |
| 3,690,265 | A | 9/1972 | Horibata |
| 3,730,520 | A | 5/1973 | Willis |
| D229,354 | S | 11/1973 | Morgan |
| 3,827,387 | A | 8/1974 | Morgan |
| 3,830,161 | A | 8/1974 | Bacon |
| 3,838,648 | A | 10/1974 | Dahlberg et al. |
| 3,853,067 | A | 12/1974 | Bacon |
| 3,861,514 | A | 1/1975 | Ling |
| 3,865,041 | A | 2/1975 | Bacon |
| 3,890,655 | A | 6/1975 | Mathis |
| 3,913,332 | A | 10/1975 | Forsman |
| 3,923,301 | A | 12/1975 | Myers |
| 3,930,450 | A | 1/1976 | Symons |
| 3,956,779 | A | 5/1976 | Jewett |
| 4,001,899 | A | 1/1977 | Mathis |
| 4,063,517 | A | 12/1977 | Nardozzi, Jr. |
| 4,073,722 | A | 2/1978 | Grutsch |
| 4,149,469 | A | 4/1979 | Bigler |
| 4,149,710 | A | 4/1979 | Rouchard |
| 4,175,361 | A | 11/1979 | Kumode |
| 4,194,733 | A | 3/1980 | Whitehouse, Jr. |
| 4,196,900 | A | 4/1980 | Becker et al. |
| 4,198,043 | A | 4/1980 | Timbes et al. |
| 4,205,785 | A | 6/1980 | Stanley |
| 4,221,170 | A | 9/1980 | Koudelka |
| 4,225,953 | A | 9/1980 | Simon et al. |
| 4,278,247 | A | 7/1981 | Joppe et al. |
| 4,299,171 | A | 11/1981 | Larson |
| 4,305,117 | A | 12/1981 | Evans |
| 4,337,704 | A | 7/1982 | Becker et al. |
| 4,376,404 | A | 3/1983 | Haddad |
| D269,082 | S | 5/1983 | Spieldiener |
| 4,391,201 | A | 7/1983 | Bailey |
| 4,392,434 | A | 7/1983 | Dürwald et al. |

4,423,864 A 1/1984 Wiik
4,429,867 A 2/1984 Barber
4,484,739 A 11/1984 Kreinbihl et al.
4,484,836 A 11/1984 Bailard
4,501,434 A 2/1985 Dupuis
4,516,943 A 5/1985 Spieldiener et al.
4,543,886 A 10/1985 Spieldiener et al.
4,545,574 A 10/1985 Sassak
4,545,583 A 10/1985 Pearman et al.
4,558,474 A 12/1985 Bastenhof
4,564,190 A 1/1986 Frenzl
4,576,512 A 3/1986 Combes et al.
4,683,686 A 8/1987 Ozdemir
4,695,058 A 9/1987 Carter, III et al.
4,696,251 A 9/1987 Spieldiener et al.
4,741,388 A 5/1988 Kuroiwa
4,759,545 A 7/1988 Grable
4,778,430 A 10/1988 Goldfarb et al.
4,783,861 A 11/1988 Leurent
4,792,260 A 12/1988 Sauerbier
4,797,027 A 1/1989 Combes et al.
4,797,605 A 1/1989 Palanisamy
4,805,896 A 2/1989 Moody
4,805,897 A 2/1989 Dubeta
4,817,312 A 4/1989 Fuller et al.
4,836,521 A 6/1989 Barber
4,850,896 A 7/1989 Smith et al.
4,854,256 A 8/1989 Hayashi
4,905,987 A 3/1990 Frenzi
4,910,814 A 3/1990 Weiner
4,939,358 A 7/1990 Herman et al.
4,954,014 A 9/1990 Sauerbier et al.
4,960,275 A 10/1990 Magon
4,963,057 A 10/1990 Fournier
4,979,679 A 12/1990 Downs
4,984,783 A 1/1991 Fujimaki
4,986,784 A 1/1991 French
5,011,134 A 4/1991 Langford
5,011,161 A 4/1991 Galphin
5,020,465 A 6/1991 Langford
5,022,588 A 6/1991 Haase
5,033,392 A 7/1991 Schemitsch
5,069,387 A 12/1991 Alba
5,069,443 A 12/1991 Shiratori
5,073,082 A 12/1991 Radlik
5,092,268 A 3/1992 Taylor
5,115,908 A 5/1992 Williams
5,137,497 A 8/1992 Dubeta
5,143,107 A 9/1992 Kelley
D330,579 S 10/1992 Briggs
5,152,210 A 10/1992 Chen
5,167,321 A 12/1992 Brodrick, Sr.
5,171,101 A 12/1992 Sauerbier et al.
5,183,437 A 2/1993 Millay et al.
5,194,048 A 3/1993 Briggs
5,213,547 A 5/1993 Lochtefeld
5,219,315 A 6/1993 Fuller et al.
5,224,652 A 7/1993 Kessler
5,230,662 A 7/1993 Langford
5,236,280 A 8/1993 Lochtefeld
RE34,407 E 10/1993 Frenzl
5,253,864 A 10/1993 Heege et al.
5,265,373 A 11/1993 Vollebregt
5,265,802 A 11/1993 Hobbs et al.
5,271,692 A 12/1993 Lochtefeld
5,299,964 A 4/1994 Hopkins
5,320,362 A 6/1994 Bear et al.
5,323,307 A 6/1994 Wolf et al.
5,378,197 A 1/1995 Briggs
5,387,158 A 2/1995 Bertrand
5,393,170 A 2/1995 Lochtefeld
5,401,117 A 3/1995 Lochtefeld
5,403,238 A 4/1995 Baxter et al.
5,405,294 A 4/1995 Briggs
5,421,451 A 6/1995 Easton
5,421,782 A 6/1995 Lochtefeld
5,426,899 A 6/1995 Jones
5,427,574 A 6/1995 Donnelly-Weide
5,433,671 A 7/1995 Davis
5,437,463 A 8/1995 Fromm
5,439,170 A 8/1995 Dach
5,452,678 A 9/1995 Simpkins
5,453,054 A 9/1995 Langford
5,461,876 A 10/1995 Dressler
5,473,233 A 12/1995 Stull et al.
5,478,281 A 12/1995 Forton
5,482,510 A 1/1996 Ishii et al.
5,494,729 A 2/1996 Henry et al.
5,499,821 A 3/1996 Rycroft
5,503,597 A 4/1996 Lochtefeld et al.
5,513,470 A 5/1996 Vollebregt
5,536,210 A 7/1996 Barber
5,540,622 A 7/1996 Gold et al.
5,564,859 A 10/1996 Lochtefeld
5,564,984 A 10/1996 Mirabella et al.
5,581,954 A 12/1996 Vollebregt
5,613,443 A 3/1997 Ariga et al.
5,623,986 A 4/1997 Wiggs
5,628,584 A 5/1997 Lochtefeld
5,649,867 A 7/1997 Briggs
5,662,525 A 9/1997 Briggs
5,664,910 A 9/1997 Lochtefeld et al.
5,667,445 A 9/1997 Lochtefeld
5,678,956 A 10/1997 Freelain
5,685,778 A 11/1997 Sheldon et al.
5,704,294 A 1/1998 Van Winkle et al.
5,716,282 A 2/1998 Ring et al.
5,732,635 A 3/1998 McKoy
5,735,748 A 4/1998 Meyers et al.
5,738,590 A 4/1998 Lochtefeld
5,741,189 A 4/1998 Briggs
5,761,776 A 6/1998 Vollebregt
5,765,314 A 6/1998 Giglio et al.
5,766,082 A 6/1998 Lochtefeld et al.
5,779,553 A 7/1998 Langford
5,785,592 A 7/1998 Jacobsen
5,791,254 A 8/1998 Mares et al.
5,809,701 A 9/1998 Vollebregt
5,816,314 A 10/1998 Wiggs et al.
5,820,471 A 10/1998 Briggs
5,820,472 A 10/1998 Briggs
D403,392 S 12/1998 Briggs et al.
5,853,332 A 12/1998 Briggs
5,860,364 A 1/1999 McKoy
5,860,766 A 1/1999 Lochtefeld et al.
5,865,680 A 2/1999 Briggs
D406,871 S 3/1999 Briggs
D407,133 S 3/1999 Briggs
5,899,633 A 5/1999 Lochtefeld
5,899,634 A 5/1999 Lochtefeld
5,911,190 A 6/1999 Lochtefeld et al.
5,927,478 A 7/1999 Archer
D413,957 S 9/1999 Briggs
5,950,253 A 9/1999 Last
5,967,901 A 10/1999 Briggs
D416,066 S 11/1999 Briggs
5,978,593 A 11/1999 Sexton
5,989,126 A 11/1999 Kilbert et al.
6,006,672 A 12/1999 Newfarmer et al.
D421,283 S 2/2000 Briggs et al.
6,036,603 A 3/2000 Mason et al.
6,045,449 A 4/2000 Aragona et al.
6,075,442 A 6/2000 Welch
6,089,987 A 7/2000 Briggs
6,105,527 A 8/2000 Lochtefeld et al.
6,113,506 A 9/2000 Nielsen 6,115,974 A 9/2000 Milanian
6,132,317 A 10/2000 Lochtefeld
6,132,318 A 10/2000 Briggs
6,139,382 A 10/2000 Eschbacher et al.
6,146,282 A 11/2000 McCready et al.
6,161,771 A 12/2000 Henry
6,162,127 A 12/2000 Ochi
6,174,242 B1 1/2001 Briggs et al.
6,178,692 B1 1/2001 Graven
6,186,902 B1 2/2001 Briggs
6,195,851 B1 3/2001 Vollebregt et al.
6,210,287 B1 4/2001 Briggs
6,231,451 B1 5/2001 Briggs
6,237,499 B1 5/2001 McKoy
6,261,186 B1 7/2001 Henry
6,264,202 B1 7/2001 Briggs
6,265,977 B1 7/2001 Vega et al.
6,272,695 B1 8/2001 Brandner
6,276,353 B1 8/2001 Briggs et al.
6,280,342 B1 8/2001 Tod
6,283,871 B1 9/2001 Briggs
6,319,137 B1 11/2001 Lochtefeld
6,320,495 B1 11/2001 Sporgis
6,336,771 B1 1/2002 Hill
6,354,955 B1 3/2002 Stuart et al.
6,362,778 B2 3/2002 Neher
6,371,717 B1 4/2002 Grams et al.
6,375,578 B1 4/2002 Briggs
6,443,849 B1 9/2002 Byrd
6,460,201 B1 10/2002 Lochtefeld
6,475,095 B1 11/2002 Henry
6,488,590 B2 12/2002 Katayama
6,491,589 B1 12/2002 Lochtefeld
6,513,284 B1 2/2003 Sandlin
6,520,853 B2 2/2003 Suzuki
6,526,158 B1 2/2003 Goldberg
6,527,646 B1 3/2003 Briggs
6,533,191 B1 3/2003 Berger et al.
6,553,336 B1 4/2003 Johnson et al.
6,561,914 B2 5/2003 Henry
6,569,023 B1 * 5/2003 Briggs ..... 472/117
6,579,175 B2 6/2003 Suzuki
6,604,327 B1 8/2003 Reville
6,608,563 B2 8/2003 Weston et al.
6,634,949 B1 10/2003 Briggs et al.
6,651,268 B1 11/2003 Briggs
6,676,530 B2 1/2004 Lochtefeld
6,702,687 B1 3/2004 Henry
6,708,706 B1 3/2004 Robinson
6,716,107 B2 4/2004 Lochtefeld
6,738,992 B2 5/2004 Lochtefeld
6,758,231 B1 7/2004 Lochtefeld et al.
6,773,355 B1 8/2004 Lekhtman
6,786,830 B2 9/2004 Briggs et al.
6,789,608 B1 9/2004 Wiggs
6,796,908 B2 9/2004 Weston
6,830,146 B1 12/2004 Scully et al.
6,928,670 B2 8/2005 Lochtefeld et al.
6,957,662 B2 10/2005 Lochtefeld et al.
6,976,434 B2 12/2005 Roig et al.
7,004,847 B2 2/2006 Henry
7,029,400 B2 4/2006 Briggs
7,040,994 B2 5/2006 Lochtefeld et al.
RE39,171 E 7/2006 Lochtefeld
7,179,173 B2 2/2007 Henry et al.
7,229,359 B2 6/2007 Henry et al.
7,263,805 B2 9/2007 Chapus
7,278,028 B1 10/2007 Hingoranee
7,285,053 B2 10/2007 Henry et al.
7,371,182 B2 5/2008 Henry et al.
7,371,183 B2 5/2008 Henry et al.
7,401,786 B2 7/2008 Lochtefeld
7,445,550 B2 11/2008 Barney et al.
2002/0072317 A1 6/2002 Livingston et al.
2002/0082097 A1 6/2002 Henry et al.
2002/0180155 A1 12/2002 Lochtefeld
2003/0190967 A1 10/2003 Henry
2003/0203760 A1 10/2003 Henry et al.
2004/0033833 A1 2/2004 Briggs et al.
2004/0077423 A1 4/2004 Weston et al.
2005/0034768 A1 2/2005 Lochtefeld et al.
2005/0047869 A1 3/2005 Lochtefeld
2005/0085306 A1 4/2005 Henry et al.
2005/0090318 A1 4/2005 Henry et al.
2005/0090319 A1 4/2005 Henry et al.
2005/0090320 A1 4/2005 Henry et al.
2005/0090322 A1 4/2005 Henry et al.
2005/0143173 A1 6/2005 Barney et al.
2005/0148398 A1 7/2005 Lochtefeld et al.
2005/0286976 A1 12/2005 Lochtefeld et al.
2005/0288111 A1 12/2005 Cowan et al.
2006/0052171 A1 3/2006 Henry et al.
2006/0111195 A1 5/2006 Henry
2006/0111196 A1 5/2006 Henry
2006/0135274 A1 6/2006 Henry
2006/0142090 A1 6/2006 Henry
2006/0154726 A1 7/2006 Weston et al.
2006/0178222 A1 8/2006 Henry et al.
2006/0214805 A1 9/2006 Boujon
2006/0229134 A1 10/2006 Briggs et al.
2006/0258471 A1 11/2006 Briggs et al.
2006/0260697 A1 11/2006 Lochtefeld et al.
2006/0287030 A1 12/2006 Briggs et al.
2007/0033866 A1 2/2007 Henry
2007/0033867 A1 2/2007 Henry
2007/0033868 A1 2/2007 Henry
2007/0049385 A1 3/2007 Henry
2007/0049386 A1 3/2007 Henry
2007/0049387 A1 3/2007 Henry
2007/0049388 A1 3/2007 Henry
2007/0051036 A1 3/2007 Henry
2007/0051037 A1 3/2007 Henry
2007/0051038 A1 3/2007 Henry
2007/0051039 A1 3/2007 Henry
2007/0054745 A1 3/2007 Henry
2007/0060402 A1 3/2007 Henry
2007/0060403 A1 3/2007 Henry
2007/0060404 A1 3/2007 Henry
2007/0066396 A1 3/2007 Weston et al.
2007/0066410 A1 3/2007 Henry
2007/0078016 A1 4/2007 Henry
2007/0087849 A1 4/2007 Henry
2007/0087850 A1 4/2007 Henry
2007/0087851 A1 4/2007 Henry
2007/0087852 A1 4/2007 Henry
2007/0087853 A1 4/2007 Henry
2007/0087854 A1 4/2007 Henry
2007/0197304 A1 8/2007 Henry et al.
2007/0219004 A1 9/2007 Henry et al.
2007/0249425 A1 10/2007 Weston et al.
2008/0014835 A1 1/2008 Weston et al.
2008/0021776 A1 1/2008 Lochtefeld
2008/0216427 A1 9/2008 Lochtefeld

FOREIGN PATENT DOCUMENTS

DE 129145 3/1902
DE 893778 10/1953
DE 4243812 A1 6/1994
EP 1318864 6/2003
EP 1604712 12/2005
WO 92/03201 3/1992
WO 92/04087 3/1992
WO 97/33668 9/1997
WO 98/45006 10/1998
WO 01/10184 2/2001

| | | |
|---|---|---|
| WO | 02/22226 | 3/2002 |
| WO | 02/22227 | 3/2002 |
| WO | 2005/042124 | 5/2005 |
| WO | 2006/057970 | 6/2006 |
| WO | 2006/113936 | 10/2006 |
| WO | 2007/019278 | 2/2007 |
| WO | 2007/027841 | 3/2007 |
| WO | 2007/028042 | 3/2007 |
| WO | 2007/028043 | 3/2007 |
| WO | 2007/035524 | 3/2007 |
| WO | 20071028040 | 3/2007 |
| WO | 2007/106717 | 9/2007 |

OTHER PUBLICATIONS

Written Opinion for PCT/US01/28535 mailed May 2, 2002.
Written Opinion for PCT/US01/28535 mailed Aug. 6, 2002.
International Preliminary Examination Report for PCT/US01/28535 issued Jan. 13, 2003.
Rorres, C. "The Turn of the Screw: Optimal Design of an Archimedes Screw" J. of Hydraulic Engineering, Jan. 2000, vol. 126, No. 1, pp. 72-80.
Office Action for U.S. Appl. No. 10/693,654 mailed on Dec. 7, 2004.
Office Action for U.S. Appl. No. 10/693,654 mailed on Jun. 10, 2005.
International Search Report for PCT/US01/28542 mailed Mar. 27, 2002.
Written Opinion for PCT/US01/28542 mailed May 2, 2002.
Written Opinion for PCT/US01/28542 issued Aug. 5, 2002.
International Preliminary Examination Report for PCT/US01/28542 issued Dec. 2, 2002.
Written Opinion for 01 970 881.7-2307 mailed Apr. 13, 2004.
Written Opinion for 01 970 881.7-2307 mailed Oct. 21, 2004.
Engineering drawing (as well as photographs of the finished product) for the Silver Dollar City water slide in Branson, Missouri, the date is unknown, however there is a 1986 copyright on the engineering drawing.
European Search Report for EP 05019093.3 mailed Oct. 28, 2005.
AA51—International Search Report and Written Opinion for PCT/US06/15503 mailed Jul. 6, 2007.
AA52—International Search Report and Written Opinion for PCT/US06/34264 mailed Jul. 24, 2007.
AA38—Exhibits related to the "Gravity Groove" slide (Sep. 1995).
AA41—Exhibits related to the "Mountain Slidewinder" ride.
Office Action for U.S. Appl. No. 11/244,866 mailed on Mar. 26, 2008, available in PAIR.
Office Action for U.S. Appl. No. 11/215,747 mailed on Mar. 18, 2008, available in PAIR.
Office Action for U.S. Appl. No. 11/215,795 mailed on Mar. 17, 2008, available in PAIR.
Office Action for U.S. Appl. No. 11/218,330 mailed on Mar. 25, 2008, available in PAIR.
Office Action for U.S. Appl. No. 11/283,503 mailed on Mar. 28, 2008, available in PAIR.
Office Action for U.S. Appl. No. 11/244,869 mailed on Apr. 8, 2008, available in PAIR.
Co-Pending U.S. Appl. No. 12/338,535 entitled, "Themed Amusement River Ride System" to Henry filed Dec. 18, 2008; available in private PAIR.
AA74—Examiner's Report for Australian Patent Application No. 2004285488 mailed Sep. 19, 2008.
Office Action for U.S. Appl. No. 11/244,866 mailed on Sep. 23, 2008, available in PAIR.
Office Action for U.S. Appl. No. 11/244,869 mailed on Nov. 13, 2008, available in PAIR.
Office Action for U.S. Appl. No. 11/407,862 mailed on Aug. 27, 2008, availaible in PAIR.
Office Action for U.S. Appl. No. 11/407,874 mailed on Sep. 8, 2008, available in PAIR.
Office Action for U.S. Appl. No. 11/407,886 mailed on Sep. 9, 2008, available in PAIR.
Office Action for U.S. Appl. No. 11/407,845 mailed on Oct. 17, 2008, availaible in PAIR.
Office Action for U.S. Appl. No. 11/407,885 mailed on Sep. 5, 2008, availaible in PAIR.
Office Action for U.S. Appl. No. 11/513,338 mailed on Jun. 12, 2008, available in PAIR.
Office Action for U.S. Appl. No. 11/513,338 mailed on Dec. 10, 2008, available in PAIR.
Office Action for U.S. Appl. No. 11/215,747 mailed on Oct. 24, 2008, available in PAIR.
Office Action for U.S. Appl. No. 11/215,795 mailed on Oct. 9, 2008, available in PAIR.
AA77—International Search Report and Written Opinion for PCT/US06/33955 mailed Apr. 4, 2008.
Office Action for U.S. Appl. No. 11/218,330 mailed on Sep. 23, 2008, available in PAIR.
Office Action for U.S. Appl. No. 11/283,503 mailed on Sep. 26, 2008, available in PAIR.
Office Action for U.S. Appl. No. 11/407,885 mailed on Jan. 30, 2009, availaible in PAIR.
Office Action for U.S. Appl. No. 11/244,866 mailed on Feb. 24, 2009, available in PAIR.
Office Action for U.S. Appl. No. 11/407,861 mailed on Mar. 12, 2009, availaible in PAIR.
Office Action for U.S. Appl. No. 11/215,795 mailed on Feb. 26, 2009, available in PAIR.
Office Action for U.S. Appl. No. 11/218,330 mailed on Mar. 20, 2009, available in PAIR.
Office Action for U.S. Appl. No. 11/283,503 mailed on Mar. 10, 2009, available in PAIR.
Office Action for U.S. Appl. No. 11/244,869 mailed on Apr. 14, 2009, available in PAIR.
Office Action for U.S. Appl. No. 11/407,845 mailed on Apr. 16, 2009, availaible in PAIR.
Office Action for U.S. Appl. No. 11/215,747 mailed on May 18, 2009, available in PAIR.
Office Action for U.S. Appl. No. 11/244,866 mailed on Oct. 21, 2009, available in PAIR.
Office Action for U.S. Appl. No. 11/407,862 mailed on Nov. 30, 2009, availaible in PAIR.
Office Action for U.S. Appl. No. 11/407,861 mailed on Oct. 15, 2009, availaible in PAIR.
Office Action for U.S. Appl. No. 11/407,874 mailed on Dec. 1, 2009, available in PAIR.
Office Action for U.S. Appl. No. 11/407,886 mailed on Nov. 18, 2009, available in PAIR.
Office Action for U.S. Appl. No. 11/407,845 mailed on Oct. 16, 2009, availaible in PAIR.
Office Action for U.S. Appl. No. 11/407,885 mailed on Dec. 2, 2009, availaible in PAIR.
Office Action for U.S. Appl. No. 11/513,338 mailed on Dec. 10, 2009, available in PAIR.
Office Action for U.S. Appl. No. 11/215,747 mailed on Oct. 23, 2009, available in PAIR.
Office Action for U.S. Appl. No. 11/215,795 mailed on Nov. 18, 2009, available in PAIR.
Advisory Action for U.S. Appl. No. 11/218,330 mailed on Nov. 9, 2009, available in PAIR.
Office Action for U.S. Appl. No. 11/244,866 mailed on Jun. 26, 2009, available in PAIR.
Office Action for U.S. Appl. No. 11/244,869 mailed on Sep. 24, 2009, available in PAIR.
Office Action for U.S. Appl. No. 11/407,862 mailed on Jun. 24, 2009, available in PAIR.
Office Action for U.S. Appl. No. 11/407,874 mailed on Jul. 14, 2009, available in PAIR.
Office Action for U.S. Appl. No. 11/407,886 mailed on Jul. 13, 2009, available in PAIR.
Office Action for U.S. Appl. No. 11/513,338 mailed on Aug. 21, 2009, available in PAIR.
Office Action for U.S. Appl. No. 11/215,795 mailed on Jun. 23, 2009, available in PAIR.
AA79—International Search Report and Written Opinion for PCT/US2007/063611 mailed Nov. 10, 2008.

Office Action for U.S. Appl. No. 11/218,330 mailed on July 22, 2009, available in PAIR.
AA80—European Office Action for EP 05019093.3 mailed Aug. 4, 2009.
Office Action for U.S. Appl. No. 11/283,503 mailed on Aug. 13, 2009, available in PAIR.
Office Action for U.S. Appl. No. 11/244,866 mailed on Mar. 26, 2010.
Office Action for U.S. Appl. No. 11/244,869 mailed on Jan. 29, 2010.
AA82 - Extended European Search Report for European Application No. 05 851 944.8 mailed on Jan. 13, 2010.
Office Action for U.S. Appl. No. 11/407,861 mailed on Mar. 17, 2010.
Office Action for U.S. Appl. No. 11/407,845 mailed on Apr. 5, 2010.
Office Action for U.S. Appl. No. 11/215,747 mailed on Feb. 25, 2010.
Office Action for U.S. Appl. No. 11/218,330 mailed on Feb. 17, 2010.

* cited by examiner

WATER AMUSEMENT PARK CONVEYOR BARRIERS

BACKGROUND OF THE INVENTION

1. Field of the Invention

The present disclosure generally relates to amusement attractions and rides. More particularly, the disclosure generally relates to a system and method for an amusement ride elevations system. Further, the disclosure generally relates to amusement rides featuring systems and methods for conveying participants between different areas of an amusement park in a safe and efficient manner. The amusement ride may include water features and/or elements.

2. Description of the Relevant Art

The 80's decade has witnessed phenomenal growth in the participatory family water recreation facility, i.e., the waterpark, and in water oriented ride attractions in the traditional themed amusement parks. The main current genre of water ride attractions, e.g., waterslides, river rapid rides, and log flumes, and others, require participants to walk or be mechanically lifted to a high point, wherein, gravity enables water, participant(s), and riding vehicle (if appropriate) to slide down a chute or incline to a lower elevation splash pool, whereafter the cycle repeats.

Generally speaking, the traditional downhill water rides are short in duration (normally measured in seconds of ride time) and have limited throughput capacity. The combination of these two factors quickly leads to a situation in which patrons of the parks typically have long queue line waits of up to two or three hours for a ride that, although exciting, lasts only a few seconds. Additional problems like hot and sunny weather, wet patrons, and other difficulties combine to create a very poor overall customer feeling of satisfaction or perceived entertainment value in the waterpark experience. Poor entertainment value in waterparks as well as other amusement parks is rated as the biggest problem of the waterpark industry and is substantially contributing to the failure of many waterparks and threatens the entire industry.

Waterparks also suffer intermittent closures due to inclement weather. Depending on the geographic location of a waterpark, the waterpark may be open less than half of the year. Waterparks may be closed due to uncomfortably low temperatures associated with winter. Waterparks may be closed due to inclement weather such as rain, wind storms, and/or any other type of weather conditions which might limit participant enjoyment and/or participant safety. Severely limiting the number of days a waterpark may be open naturally limits the profitability of that waterpark.

The phenomenal growth of waterparks in the past few decades has witnessed an evolution in water-based attractions. In the '70s and early '80s, these water attractions took the form of slides from which a participant started at an upper pool and slid by way of gravity passage down a serpentine slide upon recycled water to a lower landing pool. U.S. Pat. No. 3,923,301 to Myers discloses such a slide dug into the side of a hill. U.S. Pat. No. 4,198,043 to Timbes and U.S. Pat. No. 4,196,900 to Becker et al. disclose such slides supported on a structure. Each of these slides only allowed essentially one-dimensional movement from the upper pool, down the slide to the lower pool. Consequently, the path taken down the slide always remained the same thus limiting the sense of novelty and the unexpected for the participant after multiple uses.

Cognizant of this limitation in traditional water slides, new water attractions were developed which inserted a little more of the element of chance during the ride. One such attraction has up to twelve people seated within a circular floating ring being propelled down a flume comprising a series of man-made rapids, water falls and timed water spouts. As the floating ring moves down the path of the water attraction, contact with the sides of the flume cause the ring to rotate thus moving certain people in closer proximity to the "down-river" side of the rapids, the water falls and the spouts. Those people who were closest to such features of the water ride tended to get the most wet. Since such movement was determined mostly by chance, each participant had an equal chance of getting drenched throughout the ride by any one of the many water ride features.

This later type of ride, though an improvement over the traditional water slide, was still essentially a one-dimensional travel from an upper start area down to a lower start area where all features came into play. Furthermore, each of these features were either continuously active (such as the water fall) or automatically activated by the proximity of the floating ring to the feature.

The popularity of these types of rides has resulted in very long lines at such waterparks. Observers, such as those waiting in line for the water ride, could not interact (except verbally) with those participants on the ride. Consequently, the lasting memory at such parks may not be about the rides at the park, but the long lines and waiting required to use the rides.

SUMMARY

For the reasons stated above and more, it is desirable to create a natural and exciting amusement ride system to transport participants between rides as well as between parks that will interconnect many of the presently diverse and stand-alone waterpark rides. An amusement ride system and method are described. In some embodiments, an amusement ride system may be generally related to water amusement attractions and rides. Further, the disclosure generally relates to water-powered rides and to a system and method in which participants may be more involved in a water attraction.

In some embodiments, a portion of a path system may include special effects. The special effects may include visual effects (e.g., lighting displays). Path systems may include a conduit through which a participant may be conveyed. A portion of the conduit may be enclosed and pressurized fluids may assist conveying the participant through the enclosed conduit. The path system may inhibit the participant from exiting a portion of the path system.

An amusement ride system may include an elevation system to convey a participant from a first elevation to a second elevation. The elevation system may include, for example, a fluid jet, a conveyor belt system, an uphill water slide, a wind tunnel or a vertical jet to elevate the participant to a predetermined height. Fluid jets may fall under a broad category of elevation systems referred to as fluid assisted elevation systems.

In some embodiments, an amusement ride system may include a floating queue line. The floating queue line may be coupled to a portion of a path system. The floating queue line may include a channel. The channel may hold water at a depth sufficient to allow a participant to float within the channel. The floating queue line may be coupled to a water ride such that a participant remains in the water while being transferred from the channel along the floating queue line to the water ride.

A portion of a water path system may include a substantially horizontal channel segment including a first portion and a second portion. The portion may include a water inlet positioned at the first portion and a water outlet positioned at the second portion. Water may be transferred into the channel at the first portion and transferred out of the channel at the second portion in sufficient quantities to create a hydraulic gradient between the first portion and the second portion.

A portion of a path system may include a substantially angled channel segment including a high elevation end and a low elevation end. The angled channel segment may function such that a participant moves in a direction from the upper elevation end toward the lower elevation end. The path system may include a water inlet at the high elevation end. A predetermined amount of water may be transferred into the angled channel segment at the high elevation end such that friction between a participant and the angled channel segment is reduced. A flowing body of water may have a depth sufficient to allow a participant to float within the channel during use In some embodiments, a path system may include a plurality of fluid jets spaced apart. The fluid jets may be positioned along the path system at predetermined locations. The fluid jets may be oriented tangentially with respect to the path system surface so as to contact a participant as a participant passes by each of the locations. Each of the fluid jets may produce a fluid stream having a predetermined velocity that is selectively greater, less than, or the same as the velocity of the participant at each of the fluid jet locations.

A portion of a path system may be coupled to a walkway. A segment of the portion of the path system is at substantially the same height as a portion of the walkway such that a participant walks from the walkway into the water within the path system.

A portion of a path system may be coupled to a stairway. The stairway may function such that a participant walks along the stairway into the water within the path system.

A path system may include a docking station coupled to at least a portion of the path system. The docking station may receive and inhibit movement of inflatable vehicles to allow participants to exit or enter the inflatable vehicles.

An amusement ride system may include at least one overflow pool coupled to a path system. The overflow pool may collect water overflowing from the path system.

In some embodiments, an amusement ride may form a portion of a transportation system. The transportation system would itself be a main attraction with water and situational effects while incorporating into itself other specialized or traditional water rides and events. The system, though referred to herein as a transportation system, would be an entertaining and enjoyable part of the waterpark experience.

In certain embodiments, an amusement ride system may include a continuous water ride. Amusement ride systems may include a system of individual water rides connected together. The system may include two or more water rides connected together. Water rides may include downhill water slides, uphill water slides, single tube slides, multiple participant tube slides, space bowls, sidewinders, interactive water slides, water rides with falling water, themed water slides, dark water rides, and accelerator sections in water slides. Connecting water rides may reduce long queue lines normally associated with individual water rides. Connecting water rides may allow participants to remain in the water and/or a vehicle (e.g., a floatation device) during transportation from a first portion of the continuous water ride to a second portion of the continuous water ride.

In some embodiments, an amusement ride system may include an elevation system to transport a participant from a first elevation to a second elevation. The first elevation may be at a different elevational level than a second elevation. The first elevation may include an exit point of a first water amusement ride. The second elevation may include an entry point of a second water amusement ride. In some embodiments, a first and second elevation may include an exit and entry points of a single water amusement ride. Elevation systems may include any number of water and non-water based systems capable of safely increasing the elevation of a participant and/or vehicle. Elevation systems may include, but are not limited to, spiral transports, water wheels, ferris locks, conveyor belt systems, water lock systems, uphill water slides, and/or tube transports.

In some embodiments, an amusement ride conveyor may include an elevation system. The elevation system may function to elevate at least one participant from a lower first elevation to a higher second elevation. The elevation system may include a vertical fluid jet which functions to elevate the participant to the higher second elevation. The elevation system may include a horizontal fluid jet which functions to move the participant off of the vertical fluid jet when the participant has reached the higher second elevation. An amusement ride conveyor may include a water path system coupled to the elevation system. The water path system may function to receive the participant from the elevation system. The water path system may function such that water flows in the water path system.

In some embodiments, a system for conveying a participant from a first source of water to a second source of water may include a belt coupled to the first source of water and to the second source of water. The system may include a belt movement system, which functions to move the belt in a loop. The system may include one or more barriers which function to inhibit participants from leaving the belt as the participants are conveyed along the belt. In some embodiments, one or more of the barriers may be positioned substantially above the belt. In some embodiments, one or more of the barriers are positioned adjacent one or more sides of the belt. In some embodiments, one or more of the barriers are positioned adjacent one or more sides of the belt, and wherein at least a portion of one or more of the barriers is configured such that the contours of the portion substantially complement the contours of at least a portion of the first source of water and/or the second source of water.

In some embodiments, a system for conveying a participant from a first source of water to a second source of water may include a belt coupled to the first source of water and to the second source of water. The system may include a belt movement system, which functions to move the belt in a loop. The system may include one or more system of rollers configured to facilitate transfer of water amusement park participants onto and/or off of the belt. In some embodiments, one or more of the system of rollers may couple -a belt to a first source of water. In some embodiments, one or more systems of rollers may include a plurality of rollers coupled together such that the rollers freely rotate around a central axis. In some embodiments, one or more systems of rollers may include a plurality of rollers coupled together such that the rollers rotate around a central axis in a predetermined direction.

In some embodiments, a system for conveying a participant from a first source of water to a second source of water may include a belt; wherein the belt is coupled to the first source of water and to the second source of water. The system may include a belt movement system which functions to move the belt in a loop during use. The system may include one or more fluid jets functioning to produce a fluid stream having a predetermined velocity which is selectively greater, less than, or the same as a velocity of a participant at each of the fluid jet locations. At least some of the fluid jets may be positioned along a portion of the first source of water and/or a portion of the second source of water substantially adjacent to a portion of the belt. The fluid jets may be oriented tangentially with respect to the surface of the source of water so as to contact a participant and/or participant vehicle as a participant and/or participant vehicle passes by each of the locations.

In some embodiments, a system for controlling a participant flow rate through at least a portion of an amusement ride system may include a belt. The belt may include a first portion coupled to a first source of water and a second portion coupled to a second source of water. The system may include a belt movement system, which functions to move at least the belt in a loop. The system may include at least one gate mechanism positioned substantially adjacent the first portion and/or the second portion of the belt, wherein at least one of the gate mechanisms functions, upon activation, to position a gate to control a participant flow rate through the belt. In some embodiments, upon positioning a gate a participant is inhibited from entering a first portion of a belt. In some embodiments, upon positioning a gate a participant is inhibited from exiting a second portion of a belt. In some embodiments, the system may include a control system configured to activate and/or deactivate at least one of the gate mechanisms.

In some embodiments, a system for adjusting a portion of an elevation system for a water amusement park may include a belt coupled to a first source of water and to a second source of water. The system may include a belt movement system, which functions to move at least the belt in a loop. The system may include a support structure configured to provide support for the belt and belt movement system. The system may include one or more coupling mechanisms which function to releasably couple one or more ends of the support structure to a portion of a water amusement park. The system may include one or more cams coupled to the support structure, wherein at least one of the cams functions to spatially adjust one or more portions of the support structure. In some embodiments, a portion of a water amusement park may include a second support structure. In some embodiments, a portion of a water amusement park may include a second support structure, wherein when the coupling mechanism couples the support structure and the second support structure such that the two coupled support structure form at least a portion of a single elevation system. In some embodiments, one or more cams function to vertically adjust one or more portions of a support structure.

In some embodiments, a system for conveying a participant from a first source of water to a second source of water may include a belt coupled to the first source of water and to the second source of water. The system may include a belt movement system, which functions to move the belt in a loop. The system may include a support structure which functions to provide support for the belt and belt movement system. The system may include one or more support elements which function to support and align the belt as the belt moves between the support structure and the support elements. The support elements may be coupled to the support structure. One of the support elements may include a curved surface such that movement of the belt over the curved surface of the support element is facilitated. In some embodiments, elements of the system comprise materials resistant to deterioration due to exposure to conditions typically associated with a water amusement park. In some embodiments, one or more of the support elements comprises no moving parts. In some embodiments, one or more of the support elements may be spatially adjusted relative to the support structure.

In some embodiments, a system for controlling a participant flow rate through at least a portion of an amusement ride system may include a water channel. The water channel may couple a first body of water and a second body of water. The first body of water may be at a higher elevation than the second body of water. The system may include one or more positionable gates, wherein one or more of the gates functions to assist in controlling a first water level in the first body of water such that the velocity of water moving through the water channel from the first body of water to the second body of water is controlled. In some embodiments, elements of the system may include materials resistant to deterioration due to exposure to conditions typically associated with a water amusement park. In some embodiments, controlling the first water level and the velocity of water moving through the water channel facilitates the control of the intensity of one or more water effects. In some embodiments, controlling the first water level controls access of participants to a second water channel. In some embodiments, controlling the first water level and the velocity of water moving through the water channel facilitates the control of the intensity of one or more water effects, wherein one or more of the water effects comprise simulated water rapids.

In some embodiments, a system for controlling a participant flow rate through a multi path water amusement ride system may include a first belt; wherein the first belt is coupled to a first source of water and to a second source of water. The system may include a second belt; wherein the second belt is coupled to the first source of water and to a third source of water. A first portion of the first and second belts may be positioned substantially adjacent to each other. The system may include a first belt movement system, which functions to move at least the first belt in a loop. The system may include a second belt movement system, which functions to move at least the second belt in a loop. The system may include at least one gate mechanism positioned substantially adjacent the first portions of the first and second belts. At least one of the gate mechanisms may function upon activation, to inhibit a participant from entering the first or second belt.

In some embodiments, a system for facilitating entry of a participant on a floatation device may include a belt; wherein the belt is coupled to a first source of water and to a second source of water. The system may include a belt movement system which functions to move the belt in a loop. The first source of water and/or the second source of water may include a portion substantially adjacent the belt, wherein the portion of the first and/or second source of water comprises a depth of water which allows a participant to more easily enter a floatation device.

Depending on a water amusement parks geographic location, the waterpark may only be open for less than half of the year due to inclement weather (e.g., cold weather, rain, etc.). What is needed is a way to enclose portions or substantially all of the waterpark when weather threatens to shut down the park However, it would be beneficial to have some type of enclosure that may be at least partially removed or retracted to open up at least a portion of the waterpark to the environment during good weather.

Positionable screens may be used to substantially enclose a portion of a waterpark during inclement weather. A multitude of positionable screens may be retractable/extendable within one another. The screens may also serve other functions in addition to protecting participants from uncomfortable weather conditions. The screens may be used to trap and recirculate heat lost from, for example, the water enclosed within the screens. The positioning of the screens may be automated, manual, or a combination of both. The screens may be formed from materials that allow most of the visible light spectrum through while inhibiting transmission of potentially harmful radiation.

Other components which may be incorporated into the system are disclosed in the following U.S. Patents, herein incorporated by reference: an appliance for practicing aquatic sports as disclosed in U.S. Pat. No. 4,564,190; a tunnel-wave generator as disclosed in U.S. Pat. No. 4,792,260; a low rise water ride as disclosed in U.S. Pat. No. 4,805,896; a water sports apparatus as disclosed in U.S. Pat. No. 4,905,987; a surfing-wave generator as disclosed in U.S. Pat. No. 4,954,014; a waterslide with uphill run and floatation device therefore as disclosed in U.S. Pat. No. 5,011,134; a coupleable floatation apparatus forming lines and arrays as disclosed in U.S. Pat. No. 5,020,465; a surfing-wave generator as disclosed in U.S. Pat. No. 5,171,101; a method and apparatus for improved water rides by water injection and flume design as disclosed in U.S. Pat. No. 5,213,547; an endoskeletal or exoskeletal participatory water play structure whereupon participants can manipulate valves to cause controllable changes in water effects that issue from various water forming devices as disclosed in U.S. Pat. No. 5,194,048; a waterslide with uphill run and floatation device therefore as disclosed in U.S. Pat. No. 5,230,662; a method and apparatus for improving sheet flow water rides as disclosed in U.S. Pat. No. 5,236,280; a method and apparatus for a sheet flow water ride in a single container as disclosed in U.S. Pat. No. 5,271,692; a method and apparatus for improving sheet flow water rides as disclosed in U.S. Pat. No. 5,393,170; a method and apparatus for containerless sheet flow water rides as disclosed in U.S. Pat. No. 5,401,117; an action river water attraction as disclosed in U.S. Pat. No. 5,421,782; a controllable waterslide weir as disclosed in U.S. Pat. No. 5,453,054; a non-slip, non-abrasive coated surface as disclosed in U.S. Pat. No. 5,494,729; a method and apparatus for injected water corridor attractions as disclosed in U.S. Pat. No. 5,503,597; a method and apparatus for improving sheet flow water rides as disclosed in U.S. Pat. No. 5,564,859; a method and apparatus for containerless sheet flow water rides as disclosed in U.S. Pat. No. 5,628,584; a boat activated wave generator as disclosed in U.S. Pat. No. 5,664,910; a jet river rapids water attraction as disclosed in U.S. Pat. No. 5,667,445; a method and apparatus for a sheet flow water ride in a single container as disclosed in U.S. Pat. No. 5,738,590; a wave river water attraction as disclosed in U.S. Pat. No. 5,766,082; a water amusement ride as disclosed in U.S. Pat. No. 5,433,671; and, a waterslide with uphill runs and progressive gravity feed as disclosed in U.S. Pat. No. 5,779,553. The system is not, however, limited to only these components.

All of the above devices may be equipped with controller mechanisms to be operated remotely and/or automatically. For large water transportation systems measuring miles in length, a programmable logic control system may be used to allow park owners to operate the system effectively and cope with changing conditions in the system. During normal operating conditions, the control system may coordinate various elements of the system to control water flow. A pump shutdown will have ramifications both for water handling and guest handling throughout the system and will require automated control systems to manage efficiently. The control system may have remote sensors to report problems and diagnostic programs designed to identify problems and signal various pumps, gates, or other devices to deal with the problem as needed.

BRIEF DESCRIPTION OF THE DRAWINGS

Advantages of the present invention may become apparent to those skilled in the art with the benefit of the following detailed description of the preferred embodiments and upon reference to the accompanying drawings.

Figure 1:
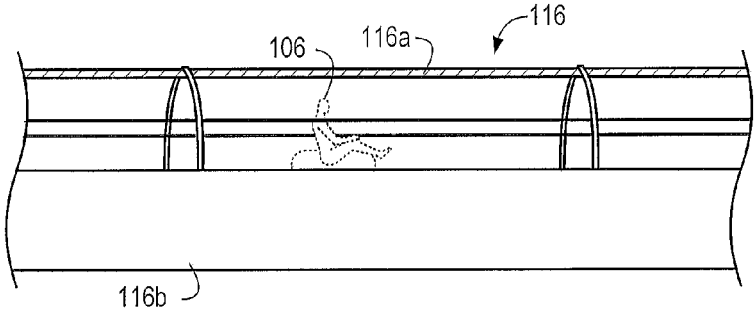
FIG. 1 depicts an embodiment of a portion of a conduit of an amusement park ride.

While the invention is susceptible to various modifications and alternative forms, specific embodiments thereof are shown by way of example in the drawing and will herein be described in detail. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims.

DETAILED DESCRIPTION

Amusement rides may include so called "water" amusement rides. Water amusement rides typically include water as an effect at least in some portion of the amusement ride. The amusement ride may include multiple different elevation points coupled to one another with some type of path system. In some embodiments, a path system may include, for example, conduits, channels, portions of natural rivers, portions of natural bodies of water, rails, and/or tracks. Path systems may include paths that split into two or more paths. Paths that have split may subsequently rejoin at a later point in the path system. A path system may include, for example, a conduit or channel. Channels typically include a water element and may include water deep enough for inflatable vehicles to float along the channel. The channel may include sides that are high enough to inhibit water within the channels from inadvertently spilling over the sides. The channel may include barriers or sides that are high enough to inhibit a participant from exiting over the sides prematurely and/or in an uncontrolled manner.

In some embodiments, a path system may include a conduit (e.g., a tube). The conduit may not include water or any type of water element. The conduit as the term implies is a substantially enclosed path system which may inhibit a participant from exiting over the sides prematurely and/or in an uncontrolled manner. "Fully enclosed" is not necessarily limited to a seamless and/or continuous sheet forming the conduit. Portions of the conduit may be formed out of a rigid material in a cage or net like formation. A perforated conduit may allow participants greater visibility and/or enjoyment during an amusement ride. The conduit may be formed from substantially transparent materials. In some embodiments, portions of the conduit may be formed from substantially transparent materials. Forming portions of a conduit from transparent materials may allow a participant greater visibility (and consequently greater enjoyment) during an amusement ride.

In some embodiments, substantially parallel bars coupled together may form a conduit. In some embodiments, mixtures of different materials and methods for forming conduits may be employed.

An embodiment of a path system may be formed from at least two materials of different transparencies. The upper portion of a path system may be formed from a substantially transparent material. The lower portion of a path system may be formed of a substantially opaque material. Advantages of such a path system may include reducing construction costs. For example various opaque construction materials may be less expensive than comparable translucent materials. The translucent portion of the path system may be less expensive to produce in part due to the fact that it is not necessary to produce the top portion to the same weight bearing capacities of the lower portion of the path system.

FIG. 1 depicts an embodiment of a portion of a path system of an amusement park ride. The embodiment of path system 116 (e.g., a channel or conduit) depicted in FIG. 1 is formed from at least two materials. The upper portion 116*a* of path system 116 may be formed from a network of restraining members (e.g., metal bars). These restraining members may act to inhibit participants from prematurely exiting the path system, while allowing participant 106 to view his/her surroundings outside of the path system as well as possibly obtain a better sense of motion. The lower portion 116*b* of path system 116 may be formed of a solid continuous material which is either substantially opaque or translucent. Advantages of such a path system may include reducing construction costs. The upper portion 116*a* of the path system may be less expensive to produce in part due to the fact that it is not necessary to produce the top half to the same weight bearing capacities of the lower portion of the path system.

Figure 2A:
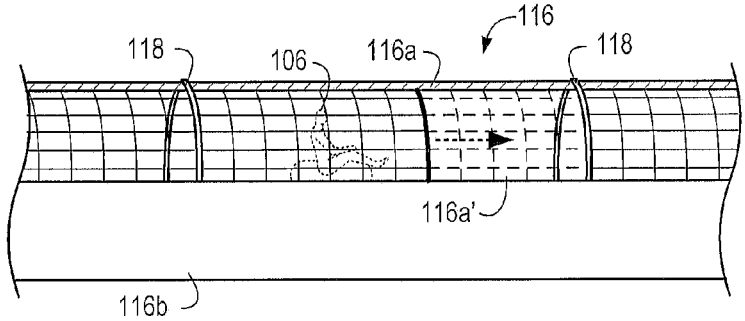
FIGS. 2A-B depict an embodiment of a portion of a conduit of an amusement park ride.
Figure 2B:
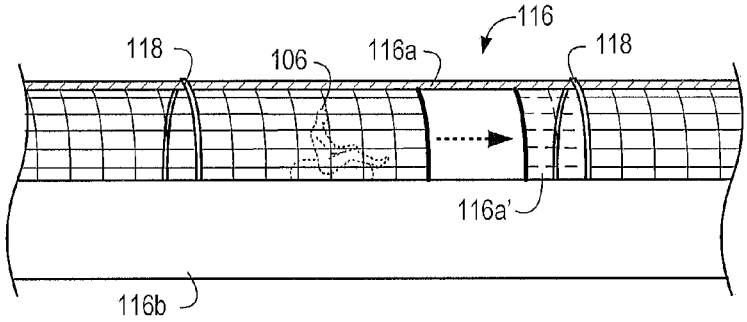

FIGS. 2A-B depict an embodiment of a portion of a path system of an amusement park ride. The embodiment of path system 116 (e.g., a conduit) depicted in FIGS. 2A-B is formed from at least two materials. Upper portion 116*a* of path system 116 may be formed from a network of restraining elongated members (e.g., flexible nets/netting). These restraining members may act to inhibit participants from prematurely exiting the path system, while allowing participant 106 to view his/her surroundings outside of the path system. The restraining members may be supported using various systems known to one skilled in the art. The embodiment depicted in FIGS. 2A-B illustrates a flexible netting forming upper portion 116*a* supported by support members 118. The lower portion 116*b* of path system 116 may be formed of a solid continuous material which is either substantially opaque or translucent. Advantages of such a path system may include reducing construction costs. The upper portion 116*a* of the path system may be less expensive to produce in part due to the fact that it is not necessary to produce the top half to the same weight bearing capacities of the lower portion of the path system.

These restraining members may also be referred to as barriers. Barriers may generally function to inhibit participants from entering or exiting a particular area. Barriers may be associated with any portion of a water amusement park and may come in a variety of forms. In some embodiments, barriers may be positioned along the sides of water amusement park features. Barriers may be positioned along the sides of water channels inhibiting participants from exiting/entering the water channel prematurely and encourage participants to use predetermined access points. In some embodiments, barriers may be positioned over portions of a water amusement park. Barriers positioned along the sides and over portions of water amusement park may function together to substantially enclose a portion of a water amusement park except for designated access points.

Barriers may be associated with portions of a water amusement park including, but not limited to, water channels, downhill water slides, uphill water slides, pools, and conveyor belts. Barriers may be constructed of rigid materials (e.g., plastics such as polycarbonates). Barrier materials may be substantially transparent (e.g., polycarbonate) and/or allow participants a virtually unimpeded view through the barriers. In some embodiments, barriers may comprise substantially flexible materials (e.g., flexible polymeric fencing materials) or comprise rigid materials fashioned in a substantially flexible manner (e.g., chain link fencing).

In some embodiments, barriers may be designed to be quickly and/or easily assembled and disassembled. Portions of barriers (e.g., portion 116*a*' as depicted in FIGS. 2A-B) may be designed to be opened such that access to a portion of the water amusement park may be gained during times of emergency or need (e.g., cleaning, mechanical failure, injury to a participant), as depicted in FIGS. 2A-B. Portions of a barrier may be designed to be drawn aside like a curtain for flexible materials (as depicted in FIGS. 2A-B) or like a sliding door for less flexible materials.

In some embodiments, barriers may server multiple functions. Barriers may do more than just inhibit access to particular portions of a water amusement park. Barriers may be designed to provide shade to participants when situated within a portion associated with the barriers. In some embodiments, barriers may act as solar panels or work as part of a heat sink. Barriers may function to inhibit participants from accessing and/or viewing a portion of a water amusement park. In some embodiments, barriers may function to serve as a structural support for other water and/or entertainment features (e.g., light shows and/or displays).

In some embodiments, a barrier may be positioned along the sides and/or above a portion of a water amusement park. One or more of the barriers may be positioned adjacent one or more sides of a conveyor belt. At least a portion of one or more of the barriers may be configured such that the contours of the portion substantially complement the contours of a portion of a waterpark.

Figure 3:
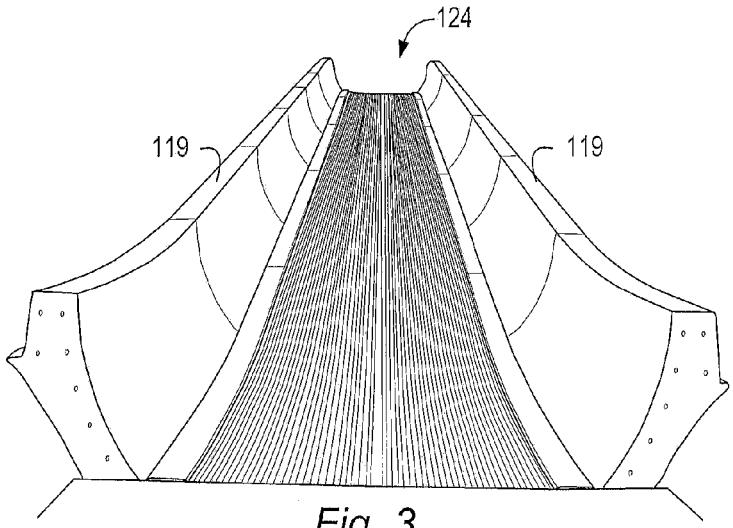
FIG. 3 depicts an embodiment of a portion of a conveyor belt including contoured barriers.

FIG. 3 depicts a portion of a conveyor belt 124 with contoured barriers 119. Contoured barriers such as the ones depicted in FIG. 3 may be formed to match portions of a waterpark (e.g., a water channel) which are coupled to the conveyor belt. Contouring barriers adds esthetically to portions of a waterpark. When barriers connecting different portions of a waterpark are complementarily contoured it provides a more seamless look. Contouring barriers of adjoining portions of a waterpark may provide advantages such as providing modular construction of portions of a waterpark including, but not limited to, elevation systems (e.g., conveyor belts). When portions of outer barriers have similar contours it facilitates interchangeability of portions of a waterpark as well as modular construction.

Figure 4:
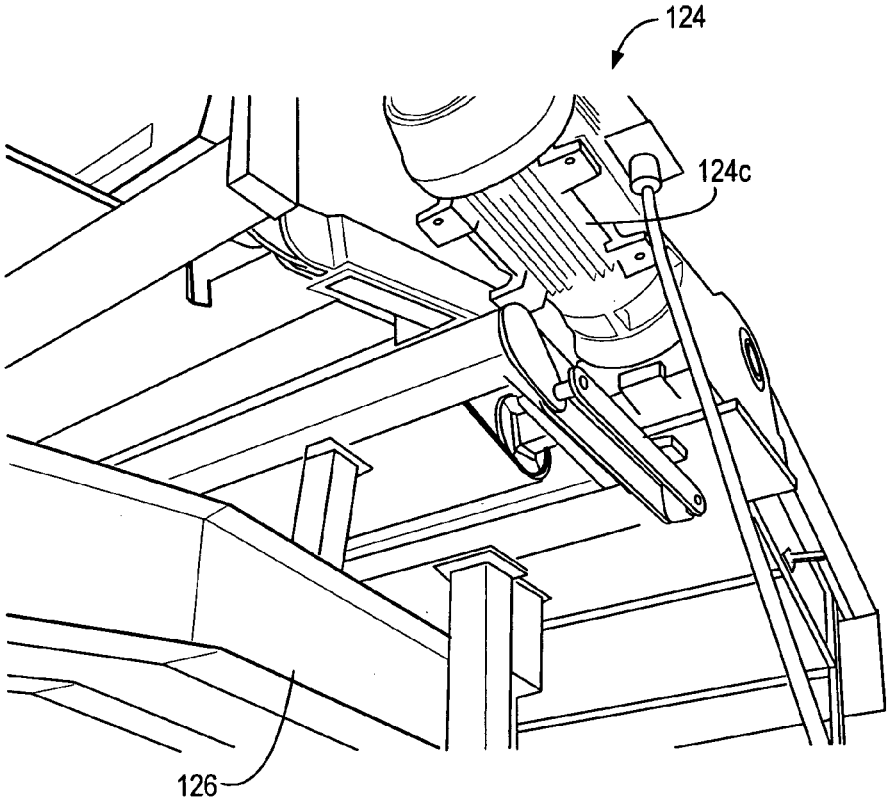
FIG. 4 depicts an embodiment of a portion of an elevation system including a support structure and contoured barriers.
Figure 5:
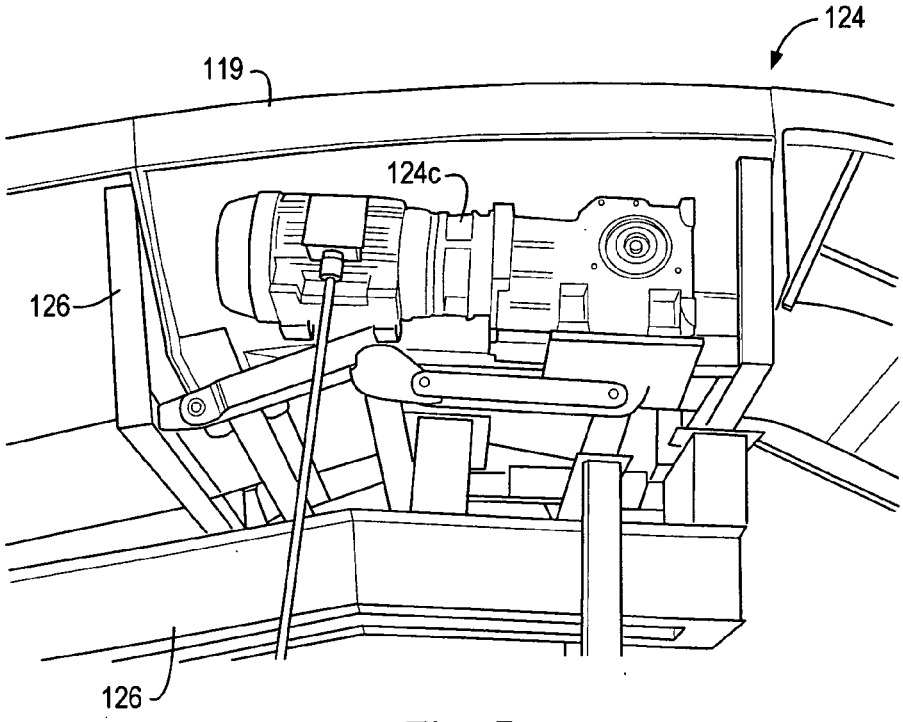
FIG. 5 depicts an embodiment of a portion of an elevation system including a support structure and contoured barriers.

In some embodiments, portions of a waterpark may be constructed on a foundation formed from a support structure 126. FIG. 4 and FIG. 5 depict an embodiment of a portion of an elevation system 124 including a support structure 126 and contoured barriers 119. FIG. 4 and FIG. 5 depicts an embodiment of drive mechanism 124*c* of a conveyor belt elevation system 124. A drive mechanism may function to move a belt in a loop.

In some embodiments, portions of a waterpark may include a spatial adjustment mechanism. Spatial adjustment mechanisms may include any mechanism capable of functioning to spatially adjust a first portion of a waterpark relative to a second portion of a waterpark. Spatial adjustment mechanisms may include a cam system. Spatial adjustment mechanisms may include a system of two or more telescoping support "legs". Advantages of a spatial adjustment mechanism may include facilitating assembly of modular portions of a waterpark.

Figure 6:
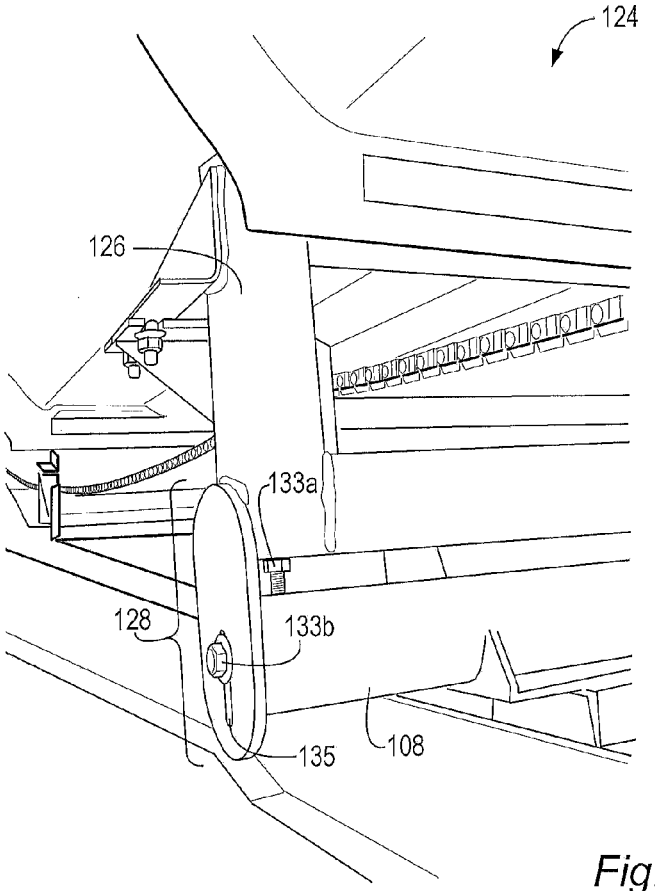
FIG. 6 depicts an embodiment of a portion of an elevation system including a spatial adjustment mechanism.
Figure 7:
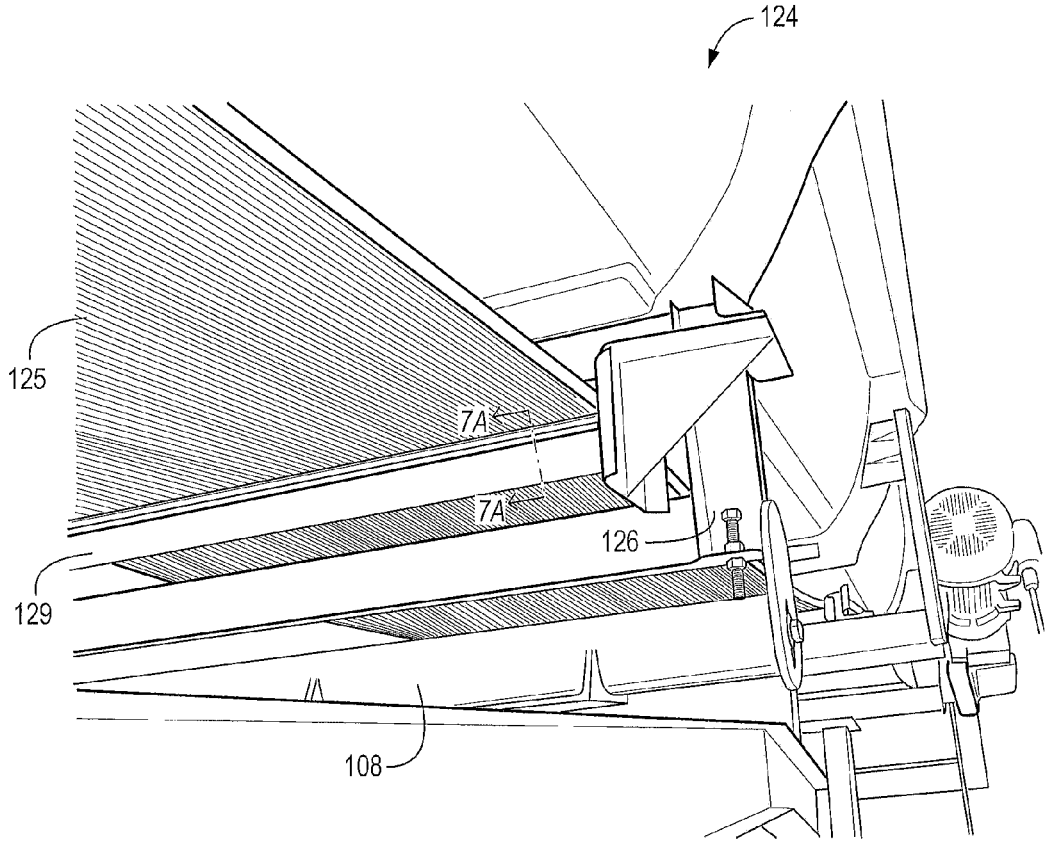
FIG. 7 depicts an embodiment of a portion of an elevation system including a spatial adjustment mechanism.
Figure 7A:
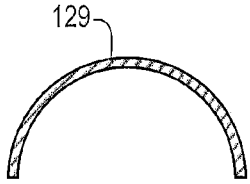

In some embodiments, a spatial adjustment mechanism may function to spatially adjust a first portion of a waterpark relative to a second portion of a waterpark such that an end of the first portion is substantially aligned with an end of the second portion. FIG. 6 and FIG. 7 depict an embodiment of a portion of an elevation system 124 including a spatial adjustment mechanism 128. The spatial adjustment mechanism 128 depicted in FIG. 6 and FIG. 7 may include bolts 133*a* and 133*b*. Bolt 133*a* may be used to adjust the distance between support structure 126 and elongated member 108 such that a first portion (e.g., a portion of a water channel, a portion of a conveyor belt, a waterslide) of a waterpark is spatially adjusted relative to a second portion (e.g., a portion of a water channel, a portion of a conveyor belt, a waterslide) of a waterpark. Bolt 133*b* may be used to inhibit movement of support structure 126 relative to elongated member 108. Bolt 133*b* may be used to inhibit movement of support structure 126 relative to elongated member 108 once bolt 133*a* has been adjusted. Bolt 133*b* may extend through opening 135 into elongated member 108. Opening 135 may be formed in an extending portion of support structure 126. Opening 135 may include a variety of shapes. A particular shape may inhibit movement of support structure 126 relative to elongated member 108. Opening 135, as depicted in FIG. 6 and FIG. 7, may include a vertical slot such that horizontal movement of support structure 126 relative to elongated member 108 is inhibited. Opening 135 may include other shapes which allow relative movement in a first direction while inhibiting movement in a second direction.

Figure 6A:
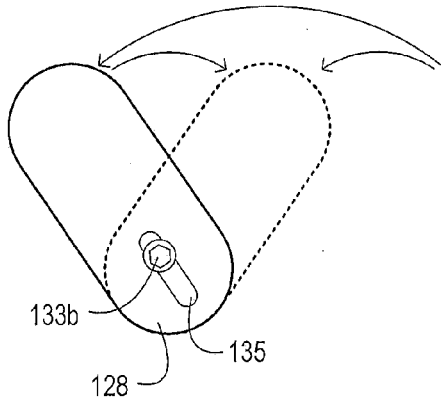
FIG. 6A depicts a side view of an embodiment of a portion of a cam adjustment system.

A cam adjustment system may function by rotation of a pivot point coupled to a support structure 126. The pivot point may include an elongated member 108. The pivot point may be coupled to the support structure via an elliptical or elongated member such that as the pivot point is rotated the support structure and anything coupled to it move in a relative direction. FIG. 6A depicts side view of an embodiment of a portion of a cam adjustment system, one example of a spatial adjustment mechanism. As can be seen in FIG. 6A the cam adjustment system may include a pivot point about which the cam adjustment system rotates.

Spatial adjustment mechanisms may include systems which function to adjust a first portion of a waterpark relative to a second portion in any dimension deemed necessary under the circumstances. Embodiments described have concentrated on vertical spatial adjustment, however, this should not be viewed as a limiting example. Systems for spatially adjusting a portion of a waterpark may adjust the portion in a horizontal plane. Systems may function to adjust a portion of a waterpark spatially in more than one dimension.

In some embodiments, a conveyor belt system may include one or more support elements coupled to the support structure. Support elements may be configured to support and align a belt as the belt moves between the support structure and the support elements. Support elements may comprise a curved surface such that movement of the belt over the curved surface of the support element is facilitated. Support elements used in association with conveyor belts may include moving parts or elements. For example a roller or a system of rollers (e.g., a belt of rollers) may be used to support a conveyor belt as the belt moves in a continuous circle. Rollers have been used to provide support for a flexible conveyor belt.

In some embodiments, a support element may have no moving parts. In some embodiments, a support element may have substantially no moving parts. Advantages of no moving parts in the support elements may include less occurrence of malfunction and need for repair especially in the harsh conditions associated with waterparks. FIG. 7 depicts an embodiment of a support element 129 with a curved surface supporting a belt 125 of a conveyor belt system 124 while facilitating movement of the belt. A curved surfaced support element may provide a smooth contact surface with no edges for a conveyor belt to bind upon or snag on. Any curved surface which supports a conveyor belt without inhibiting movement may be used. Cross sections of a support element may include, but are not limited to, oval, circular, elliptical, half moon, and/or quarter moon.

Almost all waterpark rides require substantial waiting periods in a queue line due to the large number of participants at the park. This waiting period is typically incorporated into the walk from the bottom of the ride back to the top, and can measure hours in length, while the ride itself lasts a few short minutes, if not less than a minute. A series of corrals are typically used to form a meandering line of participants that extends from the starting point of the ride toward the exit point of the ride. Besides the negative and time-consuming experience of waiting in line, the guests are usually wet, exposed to varying amounts of sun and shade, and are not able to stay physically active, all of which contribute to physical discomfort for the guest and lowered guest satisfaction. Additionally, these queue lines are difficult if not impossible for disabled guests to negotiate.

The concept of a continuous water ride was developed to address the problems and issues stated above associated with water amusement parks. Continuous water rides may assist in eliminating and/or reducing many long queue lines. Continuous water rides may eliminate and/or reduce participants having to walk back up to an entry point of a water ride. Continuous water rides may also allow the physically handicapped or physically challenged to take advantage of water amusement parks. Before that may have been difficult if not impossible due to many flights of stairs typically associated with water amusement parks.

In some embodiments, continuous water rides may include a system of individual water rides connected together. The system may include two or more water rides connected together. Amusement rides described herein may include downhill water slides, uphill water slides, single tube slides, multiple participant tube slides, space bowls, sidewinders, interactive water slides, water rides with falling water, themed water slides, dark water rides, and/or accelerator sections in water slides. Connections may reduce long queue lines normally associated with individual water rides. Connections may allow participants to remain in the water and/or in an inflatable vehicle during transportation from a first portion of the continuous water ride to a second portion of the continuous water ride.

In some embodiments, an exit point of a first water ride may be connected to an entry point of a second water ride forming at least a portion of a continuous water ride. The exit point of the first water ride and the entry point of the second water ride may be at different elevation levels. An elevation system may be used to connect the exit point of the first water ride and the entry point of the second water ride. In some embodiments, an entry point of a second water ride may have a higher elevation than an exit point of a first water ride coupled to the entry point of the second water ride.

In some embodiments, elevation systems may include any system capable of transporting one or more participants from a first point at one elevation level to a second point at a different elevation level. Elevation systems may include a conveyor belt system. Elevation systems may include a water lock system. Elevation systems may include an uphill water slide, a spiral transport system, and/or a water wheel.

Figure 8:
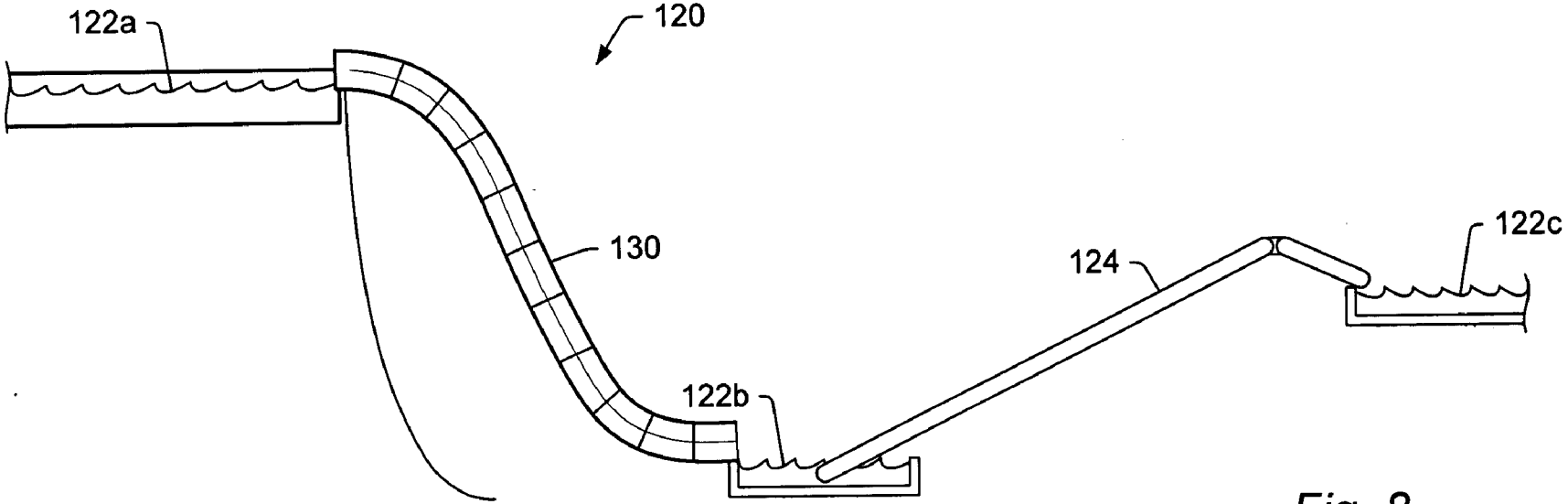
FIG. 8 depicts an embodiment of a portion of an amusement park ride.

FIG. 8 depicts an embodiment of amusement ride 120 forming at least a portion of a continuous water ride. Amusement ride 120 may include body of water 122*a*. Body of water 122*a* may include pools, lakes, and/or wells. Body of water 122*a* may be natural, artificial, or an artificially modified natural body of water. A non-limiting example of an artificially modified natural body of water might include a natural lake which has been artificially enlarged and adapted for water amusement park purposes (e.g., entry ladders and/or entry steps). Amusement ride 120 may include downhill water slide 130. Downhill water slide 130 may convey participants from body of water 122*a* at a first elevation to a lower second elevation into typically some type of water container (e.g., body of water, channel, floating queue line, and/or pool). The water container at the lower second elevation may include, for illustrative purposes only, second body of water 122*b* (e.g., a pool). Amusement ride 120 may include elevation system 124. Elevation system 124 may include any system capable of safely moving participants from a lower elevation to a higher elevation. Elevation system 124 is depicted as a conveyor belt system in FIG. 8. Elevation system 124 may convey participants to body of water 122*c*. FIG. 8 depicts merely a portion of one embodiment of amusement ride 120.

In some embodiments, bodies of water 122 may include multiple elevation systems 124 and multiple water rides connecting each other. In some embodiments, floating queue lines and/or channels may couple water rides and elevation systems. Floating queue lines may help control the flow of participants more efficiently than without using floating queue lines.

In some embodiments, elevation systems may include a conveyor belt system. Conveyor belt systems may be more fully described in U.S. Pat. No. 7,285,053, herein incorporated by reference. This system may include a conveyor belt system positioned to allow participants to naturally float up or swim up onto the conveyor and be carried up and deposited at a higher level.

The conveyor belt system may also be used to take participants out of the water flow at stations requiring entry and/or exit from the amusement ride. Participants float to and are carried up on a moving conveyor. Participants may be transported into the amusement ride at a desired location and velocity. The conveyor may extend below the surface of the water so as to more easily allow participants to naturally float or swim up onto the conveyor. Extending the conveyor below the surface of the water may allow for a smoother entry into the water when exiting the conveyor belt. Typically the conveyor belt takes participants from a lower elevation to a higher elevation, however it may be important to first transport the participants to an elevation higher than the elevation of their final destination. Upon reaching this apex the participants then may be transported down to the elevation of their final destination on a water slide, rollers, or on a continuation of the original conveyor that transported them to the apex. This serves the purpose of using gravity to push the participant off and away from the belt, slide, or rollers into a second water ride of the continuous water ride and/or a floating queue. The endpoint of a conveyor may be near a first end of a horizontal hydraulic head channel wherein input water is introduced through a first conduit. This current of flowing may move the participants away from the conveyor endpoint in a quick and orderly fashion so as not to cause increase in participant density at the conveyor endpoint. Further, moving the participants quickly away from the conveyor endpoint may act as a safety feature reducing the risk of participants becoming entangled in any part of the conveyor belt or its mechanisms. A deflector plate may also extend from one or more ends of the conveyor and may extend to the bottom of the channel. When the deflector plate extends at an angle away from the conveyor it may help to guide the participants up onto the conveyor belt as well as inhibit access to the rotating rollers underneath the conveyor. These conveyors may be designed to lift participants from one level to a higher one, or may be designed to lift participants out of the water, onto a horizontal moving platform.

In some embodiments, a belt may include a series of interlocking plates or pieces. A belt so constructed may be more durable. Examples of such a belt may be purchased commercially from Intralox, L.L.C.

The conveyor belt speed may also be adjusted in accordance with several variables. The belt speed may be adjusted depending on the participant density; for example, the speed may be increased when participant density is high to reduce participant waiting time. The speed of the belt may be varied to match the velocity of the water, reducing changes in velocity experienced by the participant moving from one medium to another (for example from a current of water to a conveyor belt). Conveyor belt speed may be adjusted so participants are discharged at predetermined intervals, which may be important where participants are launched from a conveyor to a water ride that requires safety intervals between the participants.

Several safety concerns should be addressed in connection with the conveyor system. The actual belt of the system should be made of a material and designed to provide good traction to participants without proving uncomfortable to the participants touch. Detection devices or sensors for safety purposes may also be installed at various points along the conveyor belt system. These detection devices may be variously designed to determine if any participant on the conveyor is violating safety parameters. Gates may also be installed at the top or bottom of a conveyor, arranged mechanically or with sensors wherein the conveyor stops when the participant collides with the gate so there is no danger of the participant being caught in and pulled under the conveyor. Runners may cover the outside edges of the conveyor belt covering the space between the conveyor and the outside wall of the conveyor so that no part of a participant may be caught in this space. All hardware (electrical, mechanical, and otherwise) should be able to withstand exposure to water, sunlight, and various chemicals associated with water treatment (including chlorine or fluorine) as well as common chemicals associated with the participants themselves (such as the various components making up sunscreen or cosmetics).

In some embodiments, a conveyor belt system may include restraining devices and/or gripping devices. Restraining devices may be used to inhibit participants from moving while on the conveyor belt (other than the movement associated with the movement of the conveyor belt itself when activated).

Various sensors may also be installed along the conveyor belt system to monitor the number of people using the system in addition to their density at various points along the system. Sensors may also monitor the actual conveyor belt system itself for breakdowns or other problems. Problems include, but are not limited to, the conveyor belt not moving when it should be or sections broken or in need of repair in the belt itself. All of this information may be transferred to various central or local control stations where it may be monitored so adjustments may be made to improve efficiency of transportation of the participants. Some or all of these adjustments may be automated and controlled by a programmable logic control system.

Various embodiments of the conveyor lift station include widths allowing only one or several participants side by side to ride on the conveyor according to ride and capacity requirements. The conveyor may also include entry and exit lanes in the incoming and outgoing stream so as to better position participants onto the conveyor belt and into the outgoing stream.

Figure 9:
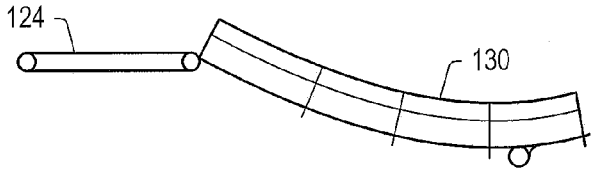
FIG. 9 depicts a side view of an embodiment of a conveyor lift station coupled to a water ride.
Figure 10:
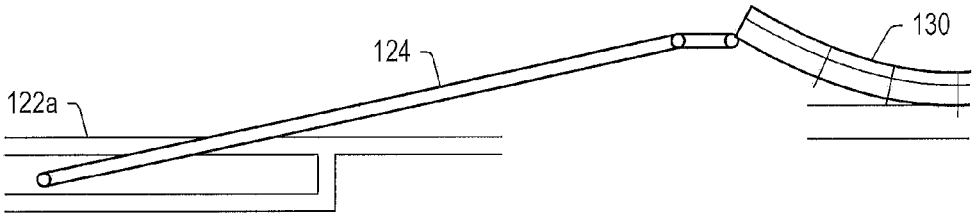
FIG. 10 depicts a side view of an embodiment of a conveyor lift station with an entry conveyor coupled to a water slide.
Figure 11:
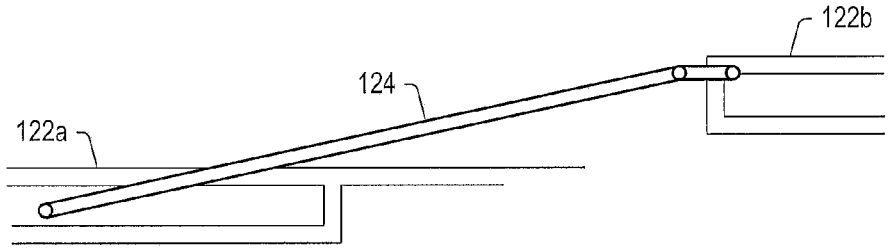
FIG. 11 depicts a side view of an embodiment of a conveyor lift station coupled to an upper channel.

More embodiments of conveyor systems are shown in FIG. 9-FIG. 11. FIG. 9 shows a dry conveyor for transporting participants entering the system into a channel. It includes a conveyor belt portion ending at the top of downhill slide 130 which participants slide down on into the water. FIG. 10 shows a wet conveyor for transporting participants from lower channel 122*a* to a higher one with downhill slide 130 substituted for the launch conveyor. FIG. 11 shows a river conveyor for transporting participants from channel 122*a* to a torrent river 122*b*. This embodiment does not have a descending portion.

Figure 12:
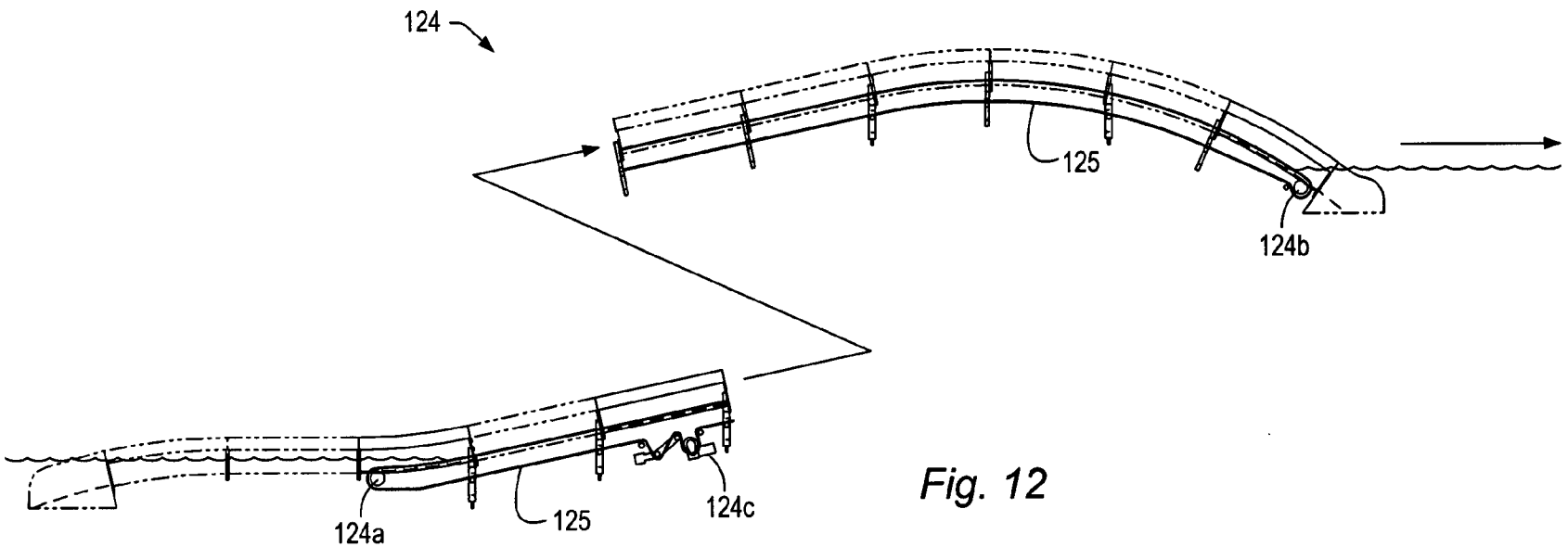
FIG. 12 depicts an embodiment of an elevation system.

FIG. 12 through FIG. 28 depict embodiments of conveyor belt elevation systems as well as embodiments of specific portions of the conveyor belt elevation systems. FIG. 12 depicts an embodiment of conveyor belt elevation system 124. Conveyor belt elevation system 124 may be used to convey participants from a lower first elevation to a higher second elevation. Although generally elevation systems described herein are used for moving participants and/or participant carriers from a lower to a higher elevation, it should be noted that with little to no modification elevation systems described herein may be used to convey participants and/or participant carriers from a higher to a lower elevation or even convey participants over a specified distance along a substantially constant elevation.

Figure 13:
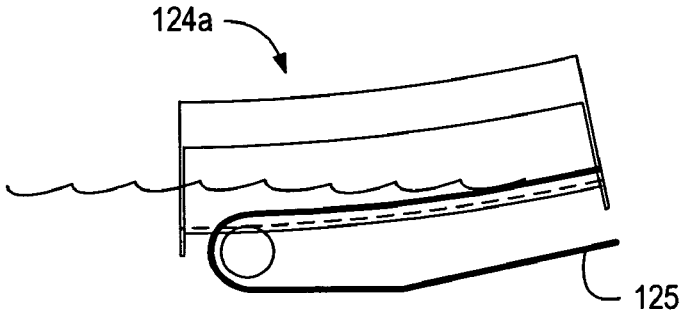
FIG. 13 depicts an embodiment of an entry portion of an elevation system.
Figure 14:
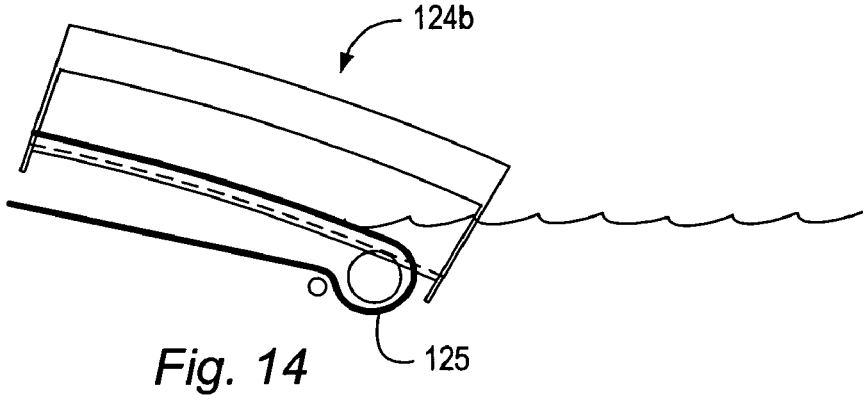
FIG. 14 depicts an embodiment of an exit portion of an elevation system.
Figure 15:
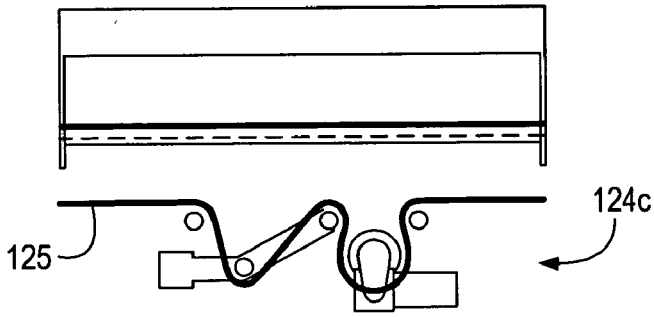
FIG. 15 depicts an embodiment of a drive mechanism of an elevation system.

FIG. 13 through FIG. 15 depict embodiments of specific portions of conveyor belt elevation system depicted in FIG. 12. Conveyor belt elevation systems may include conveyor belt 125. FIG. 13 depicts an embodiment of entry portion 124*a* of a conveyor belt elevation system. Entry portion 124*a* may be substantially submerged under water during operation of a conveyor belt elevation system. Submerging the entry portion may function to ensure a smooth transition for participants from a water filled channel onto a belt of the conveyor belt elevation system. The entry portion may include sensors which function to detect when participants have entered the conveyor belt elevation system.

FIG. 14 depicts an embodiment of exit portion 124*b* of a conveyor belt elevation system. Exit portion 124*b* may be substantially submerged under water during operation of a conveyor belt elevation system. Submerging the exit portion may function to ensure a smooth transition for participants from a belt of the conveyor belt elevation system into a water filled channel or some other portion of an amusement ride. The exit portion may include sensors which function to detect when participants have exited the conveyor belt elevation system.

FIG. 15 depicts an embodiment of drive mechanism 124*c* of a conveyor belt elevation system. FIG. 15 depicts how a conveyor belt may thread through a drive mechanism. The drive mechanism depicted specifically is used for situations where drive mechanisms cannot be located at the upper end of the conveyor belt (e.g., river lifts).

Figure 16:
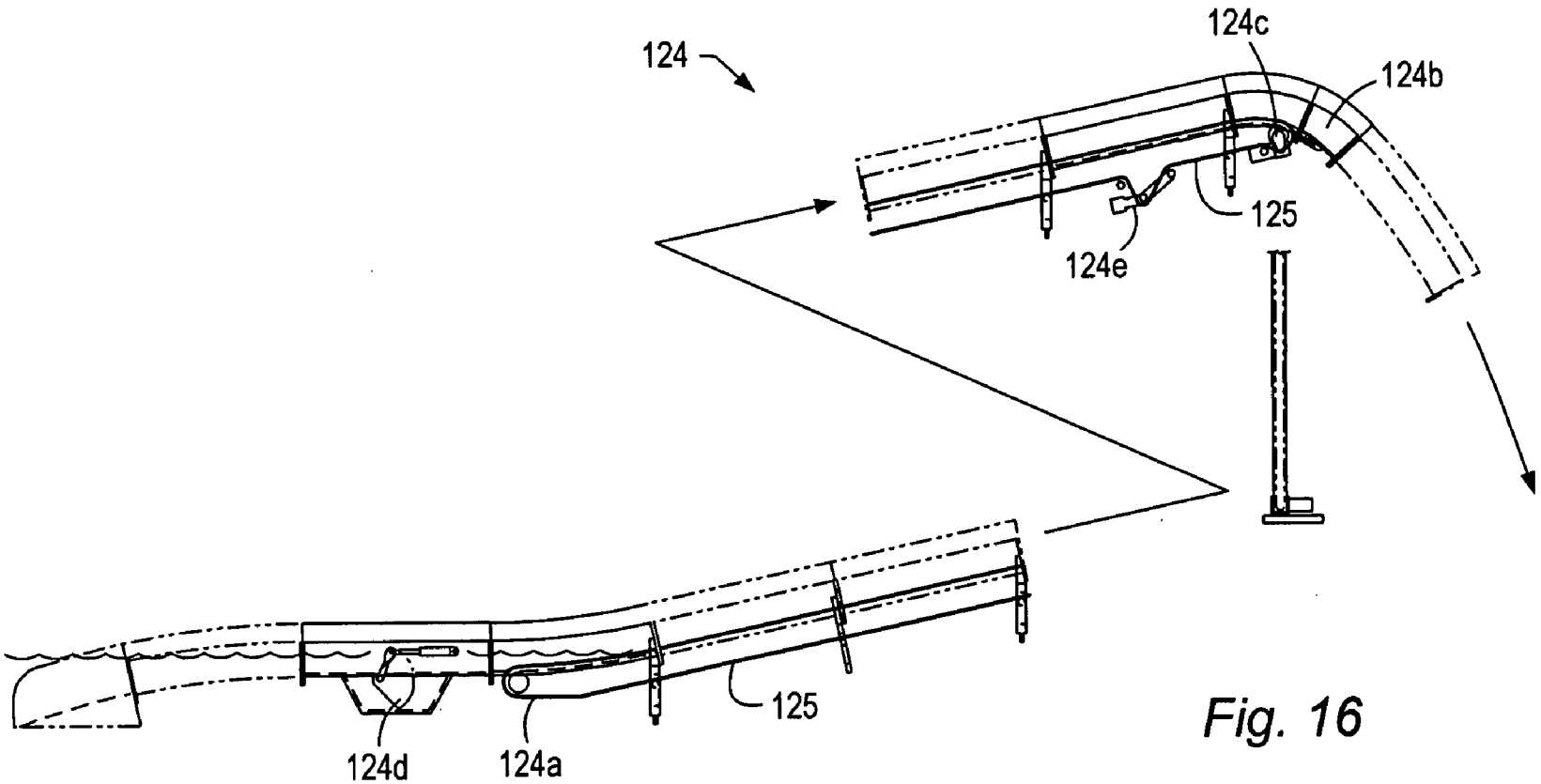
FIG. 16 depicts an embodiment of an elevation system.

FIG. 16 depicts an embodiment of conveyor belt elevation system 124. Conveyor belt elevation system 124 may include entry portion 124*a* as depicted in, for example, FIG. 13. Conveyor belt elevation system 124 may include exit portion 124*b*, drive mechanism 124*c*, gate mechanism 124*d*, and tension mechanism 124*e*.

Figure 17:
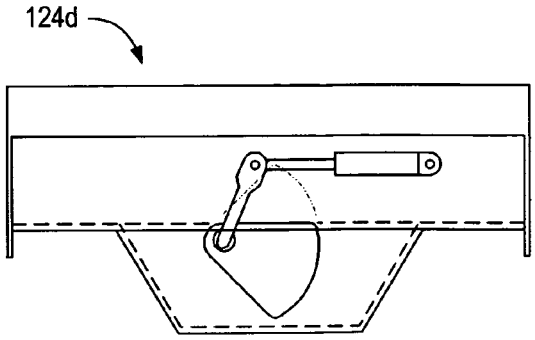
FIG. 17 depicts an embodiment of a gate mechanism of an elevation system.

FIG. 17 depicts an embodiment of gate mechanism 124*d*. Gate mechanism 124*d* may function to control the access rate of participant and/or participant carriers onto conveyor belt elevation system 124. The gate mechanism may ensure that only one participant carrier enters the conveyor belt system at a time and/or maintain optimal spacing between participant carriers along the conveyor belt system.

In some embodiments, a gate mechanism may include a positionable arm. The positionable arm may be coupled to a dam or gate. The gate may be buoyant and function to hinder the progress of participants. The positionable arm may function to position the gate in an upward hindering position as depicted in FIG. 17. The positionable arm may function to position the gate in a position to allow participants to pass unhindered (e.g., retracting the gate so it is flush with the floor of, for example, a channel).

The gate mechanism may function such that few or no pinch points are accessible to a participant. The gate mechanism may be driven by outboard actuators (e.g., hydraulic or pneumatic). The gate mechanism may include a pivot shaft, actuators, and local drive unit. The gate mechanism may include sensors. Some of the sensors may communicate the position of the gate to a programmable controller. Some of the sensors may detect when participants approach the gate. Some of the sensors may detect when participants have safely cleared the gate. Sub-framework of the gate may be mounted directly to the path system flooring (e.g., concrete).

FIG. 17 depicts only one embodiment of gate mechanism 124*d*, in other embodiments gate mechanisms may include adjustable weirs as described herein. Gate mechanisms may include any mechanism which is capable of controlling the flow of participants through a section or portion of a water amusement park.

Figure 18:
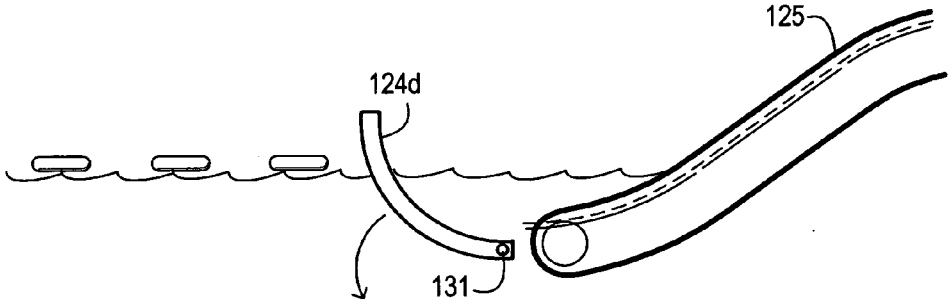
FIG. 18 depicts an embodiment of a gate mechanism of an elevation system.

In some embodiments, a gate mechanism may include a cam-like structure. One end of the cam-like structure may be coupled to a pivot point which rotates a gate mechanism into position to inhibit participants from accessing an end of a conveyor belt. FIG. 18 depicts an embodiment of gate mechanism 124*d*. FIG. 18 depicts an embodiment of a gate mechanism where a pivot point 131 of the gate mechanism is positioned such that the gate is positioned below conveyor belt 125 and when activated moves up from below to inhibit participants access.

Figure 19:
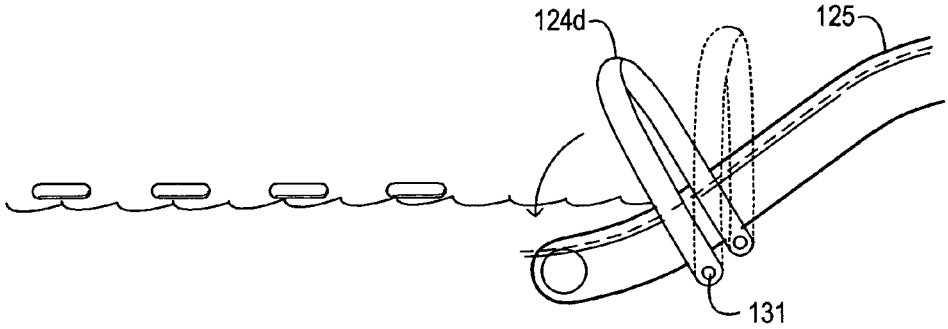
FIG. 19 depicts an embodiment of a gate mechanism.

FIG. 19 depicts an embodiment of gate mechanism 124*d*. FIG. 19 depicts an embodiment of a gate mechanism where a pivot point 131 of the gate mechanism is positioned such that the gate is positioned above conveyor belt 125 and when activated moves down from above to inhibit participant's access.

In some embodiments, gate mechanisms may be used to direct participants toward one or more paths when there exists two or more alternative path choices built into a water amusement park ride system. The gate mechanism may be coupled to a control system. The control system and/or gate mechanism may be coupled to sensors. The control system may be at least partially automated.

In some embodiments, participants may signal which path option they prefer and a gate mechanism may comply appropriately with the participant's choice. For example, a participant may signal manually (e.g., vocally or using hand signals) which path option the participant prefers. Using motion detectors and/or voice recognition software may allow a control system to automatically position a gate mechanism such that a participant enters the desired path option. In some embodiments, a gate mechanism may be manually controlled by an operator. In some embodiments, a participant may use a personal electronic signally device to indicate which path option they prefer. For example a participant identifier may be used as described in U.S. Pat. No. 7,229,359 entitled "CONTINUOUS WATER RIDE," herein incorporated by reference.

In some embodiments, a gate mechanism may function to regulate the flow of participants between a multi-path option such that participants are distributed appropriately to maintain a maximum participant flow rate reducing participant waiting times. Appropriately distributing participants between path options of a water amusement ride and/or elevation system may include substantially evenly distributing participants between path options. Appropriately distributing participants between path options of a water amusement ride and/or elevation system may include distributing participants between path options based on each path's particular participant flow capacity.

Figure 20:
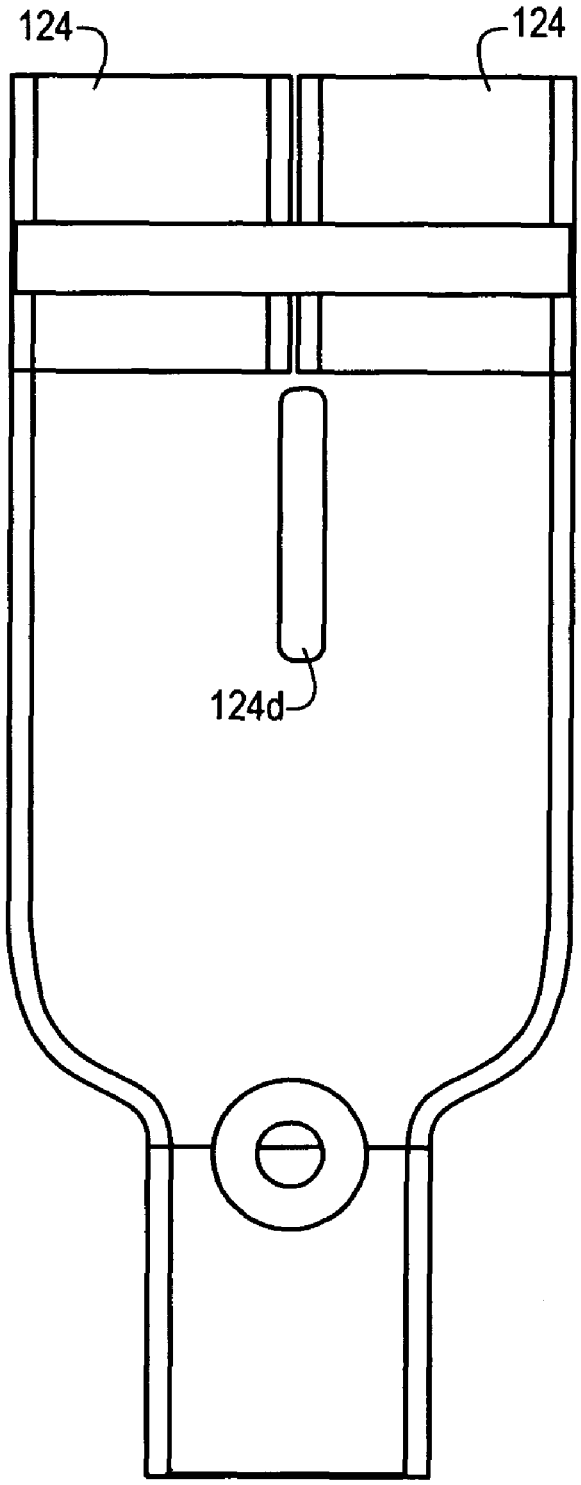
FIG. 20 depicts an embodiment of a gate mechanism.

FIG. 20 depicts an embodiment of gate mechanism 124*d*. Gate mechanism 124*d* depicted in FIG. 20 is configured to distribute participants between two conveyor belt elevation systems 124. Gate mechanism 124*d* depicted in FIG. 20 is depicted in a neutral position with both path options available. The gate mechanism may pivot from side to side selectively blocking and opening the different path options (e.g., conveyor belt elevation system). FIG. 20 depicts an embodiment including two path options (e.g., conveyor belt elevation system); however, other embodiments may include any number of path options through which the flow of participants may or may not be controlled using one or more gate mechanisms or similar devices.

One skilled in the art may use and/or modify common methods and devices to act as or accomplish similar ends of the gate mechanism (e.g., diverting participants between path options and/or controlling the flow of participants through a particular section of a water amusement ride and/or system).

Figure 21:
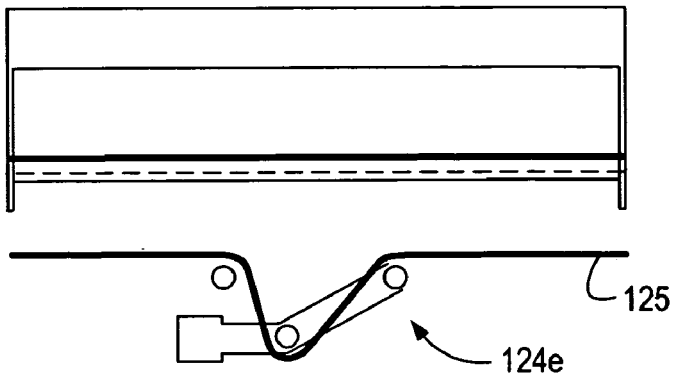
FIG. 21 depicts an embodiment of a tension mechanism of an elevation system.

FIG. 21 depicts an embodiment of tension mechanism 124*e* of a conveyor belt elevation system. Tension mechanism 124*e* may function to provide additional tension to a conveyor belt 125 when necessary. The tension mechanism may include sensors. Some of the sensors may detect when there is not enough tension on the conveyor belt. Sensors may be coupled to a programmable controller. The tension mechanism may include a lock-out feature. The lock-out feature of the tension mechanism may function to release tension on the conveyor belt to, for example, allow maintenance.

Figure 24:
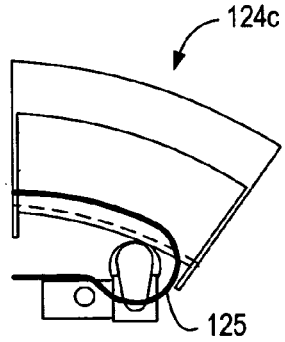
FIG. 24 depicts an embodiment of a drive mechanism of an elevation system.

FIG. 24 depicts an embodiment of drive mechanism 124*c* of a conveyor belt elevation system. FIG. 24 depicts how a conveyor belt may thread through a drive mechanism. The embodiment depicted in FIG. 24 is adapted for an upper end of a conveyor belt system to launch a participant carrier into a downhill portion of an amusement ride (e.g., a downhill slide). The embodiment depicted in FIG. 24 may require a separate tension mechanism as depicted in FIG. 16 and FIG. 21.

Figure 25:
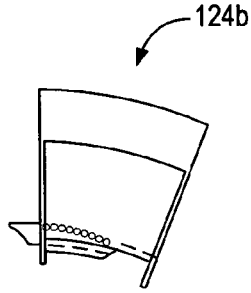
FIG. 25 depicts an embodiment of an exit portion of an elevation system.

FIG. 25 depicts an embodiment of exit portion 124*b* of a conveyor belt elevation system. Exit portion 124*b* depicted in FIG. 25 may provide a relatively safe interface between an end of a conveyor belt elevation system and another portion of an amusement ride. A conveyor belt interface with the exit portion may include a mating comb, such as provided from Intralox. The exit portion may include a section of roller belt (e.g., Intralox's Series 400 Roller Top). The section of roller belt may ease a participant off of the belt conveyor. In some embodiments, both a comb and a roller belt may be pre-assembled to a tray. The tray may be formed from stainless steel. The tray may couple directly inside a cavity of the floor of an amusement ride.

Figure 22:
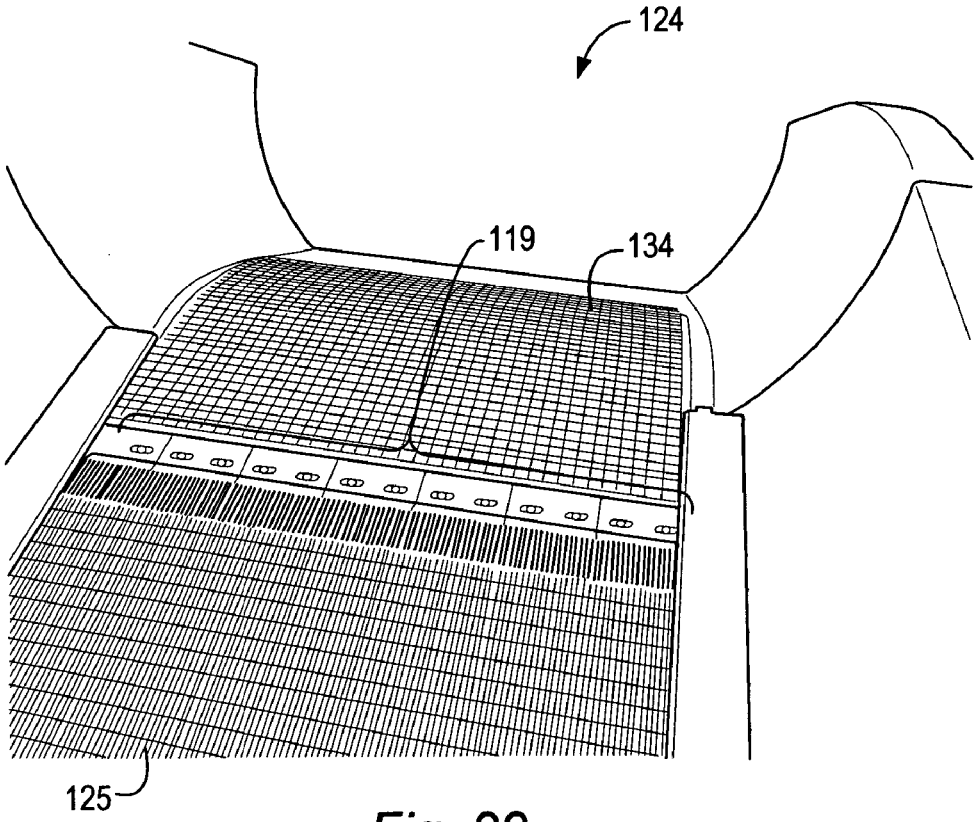
FIG. 22 depicts an embodiment of a system of rollers.
Figure 23:
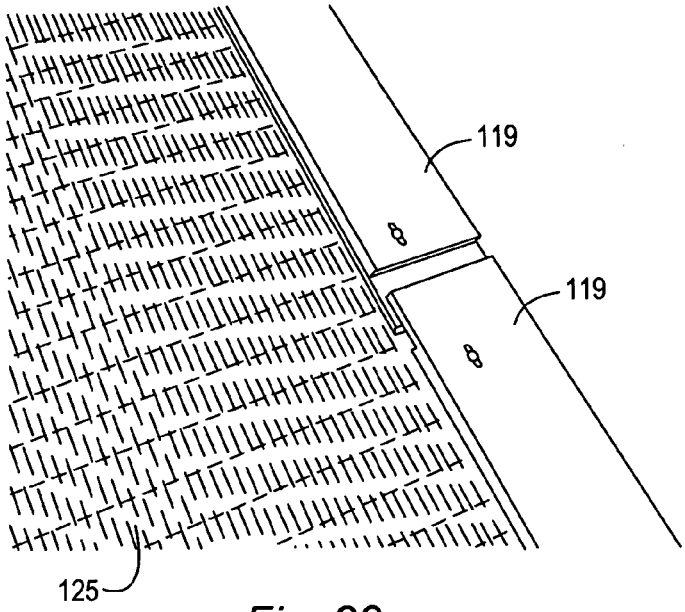
FIG. 23 depicts an embodiment of a portion of a belt and a barrier.

FIG. 22 depicts an embodiment of a system of rollers 134 at the end of a conveyor belt system 124. FIG. 22 depicts and embodiment of a mating comb transitioning a conveyor belt to the system of rollers. The mating comb may function as barrier 119 to inhibit participants from accessing the space between the end of conveyor belt 125 and the beginning of the system of rollers. FIG. 23 depicts an embodiment of a portion of a belt 125 and a barrier 119. The barrier depicted in FIG. 23 may function to inhibit participants from accessing the area beneath the moving belt.

A system of rollers may facilitate transfer of water amusement park participants onto and/or off of a portion of a water amusement park (e.g., conveyor belt, water channel or slide). In some embodiments, a system of rollers may ease the transition for participants onto and/or off of a conveyor belt. A system of rollers may include a plurality of rollers coupled together such that the rollers freely rotate about a central axis. In some embodiments, a system of rollers may include a plurality of rollers coupled together such that the rollers rotate about a central axis in a predetermined direction.

Rollers may be formed from materials which are resistant to conditions typically associated with a water amusement park. Rollers may be formed from materials with a low coefficient of friction to assist participants in transferring from different portions of a water amusement park In some embodiment, roller may comprise materials which provide at least some give such that rollers are not uncomfortable for participants to traverse. In some embodiments, a system of rollers may function to have a certain amount of "give" built into them while still functioning to transfer participants. Rows of rollers may be linked such that there is a predetermined amount of flexibility between the rows of rollers such that the system of rollers as a whole flexes at least slightly. Slight flexing of the system of rollers may reduce the occurrence and severity of potential injuries associated with participants using the system of rollers to transfer from one portion of a waterpark to another portion of a waterpark, if for example the participant is traveling at a high rate of speed when the participant transfers to the system of rollers.

In some embodiments, a system of rollers may include a plurality of a series of individual rollers coupled together with an elongated member. In some embodiments, a system of roller may include a plurality of single rollers with an elongated member positioned through the roller. The elongated member upon which rollers rotate about may be formed from substantially rigid and/or substantially flexible materials.

In some embodiments, a launch conveyor may function as a transition between portions of a waterpark. A launch conveyor may be modular, facilitating insertion of the launch conveyor into portions of a waterpark. In certain embodiments, a launch conveyor may include a relatively short conveyor belt which is used to launch a participant to provide the participant with extra momentum before entering a portion of a water ride. A launch conveyor may be inserted in between a floating queue line and/or a downhill water slide. A launch conveyor may assist in controlling a participant flow rate.

In some embodiments, a launch conveyor may include a mechanism for adjusting an angle of ascent/descent of the conveyor. Adjusting the angle of ascent/descent may allow a launch conveyor to assist launching participants in a variety of ways including uphill, downhill, and horizontally.

Figure 26:
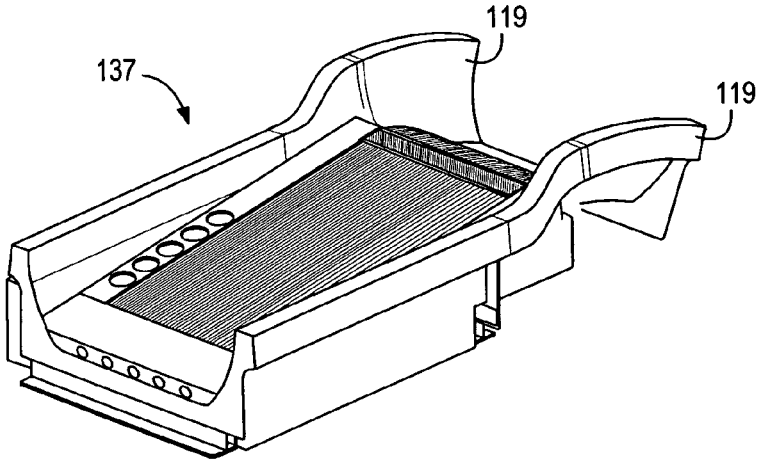
FIG. 26 depicts an embodiment of a modular conveyor belt system.

In some embodiments, a launch conveyor may include a pump to assist in recirculating water such that there is not a build up of water at any point in a waterpark system. FIG. 26 depicts an embodiment of a modular conveyor belt system 137.

Figure 27:
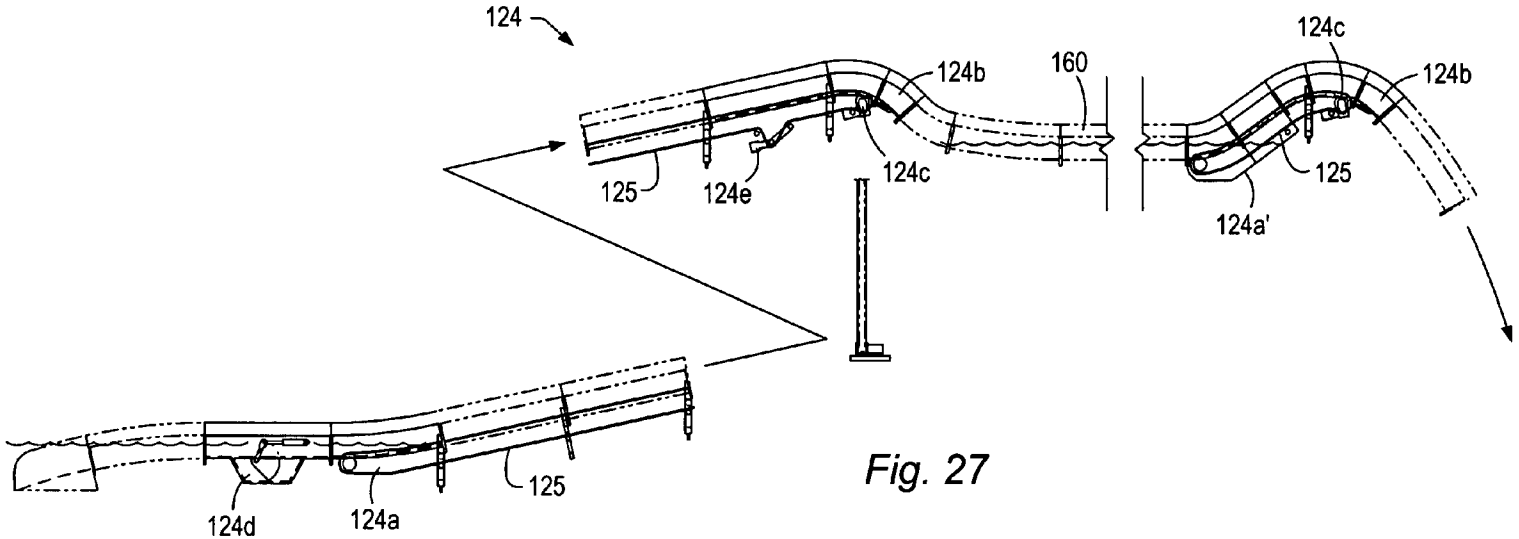
FIG. 27 depicts an embodiment of an elevation system.

FIG. 27 depicts an embodiment of conveyor belt elevation system 124. Conveyor belt elevation system 124 may include entry portions 124*a*', entry portion 124*a*, exit portion 124*b*, drive mechanism 124*c*, gate mechanism 124*d*, and tension mechanism 124*e*.

Figure 28:
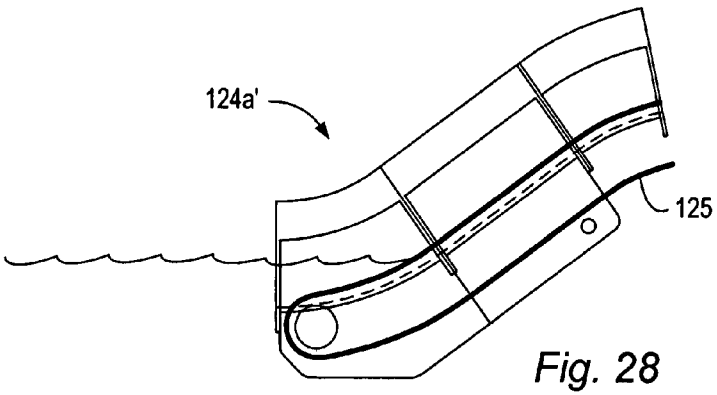
FIG. 28 depicts an embodiment of an entry portion of an elevation system.

FIG. 28 depicts an embodiment of entry portion 124*a*' of a conveyor belt elevation system. It should be noted that the embodiment depicted in FIG. 28 may be used at either an exit or entry point as may many of the embodiments described herein. The beginning of the entry portion may be set below water level during use to ease participants on the conveyor belt. The entry portion may be located at the end of floating queue system 160 as depicted in FIG. 27. Entry portion 124*a*' may bring floating participants up out of the floating queue channel and into a subsequent portion of an amusement ride. Entry portion 124*a*' may be combined with exit portion 124*b* and drive mechanism 124*c* as depicted in FIG. 27 to form a second conveyor belt system. The entry portion may include sensors to detect when participants actually enter the portion. In some embodiments, the second conveyor belt system may function to provide momentum to participants and/or participant vehicles as they enter a portion of the water amusement park (e.g., a water slide) coupled to exit portion 124*b*. In some embodiments, a first conveyor belt (e.g., as depicted in FIG. 27) may function to adjust a participant flow rate. The adjustment may be done manually or using an automated control system. The first conveyor belt system may adjust the participant flow rate by adjusting the belt speed of the conveyor belt system using drive mechanism 124*c*. In some embodiments, a floating queue system (e.g., as depicted in FIG. 27) may function to adjust a participant flow rate. The adjustment may be done manually or using an automated control system. The floating queue system may adjust the participant flow rate by adjusting the output and/or number of fluid jets employed in the floating queue system. In some embodiments, the first conveyor belt system and the floating queue system may function together to adjust a participant flow rate.

In some embodiments, the first conveyor belt system, the second conveyor belt system, and the floating queue system may function in combination to adjust a participant flow rate.

Figure 30:
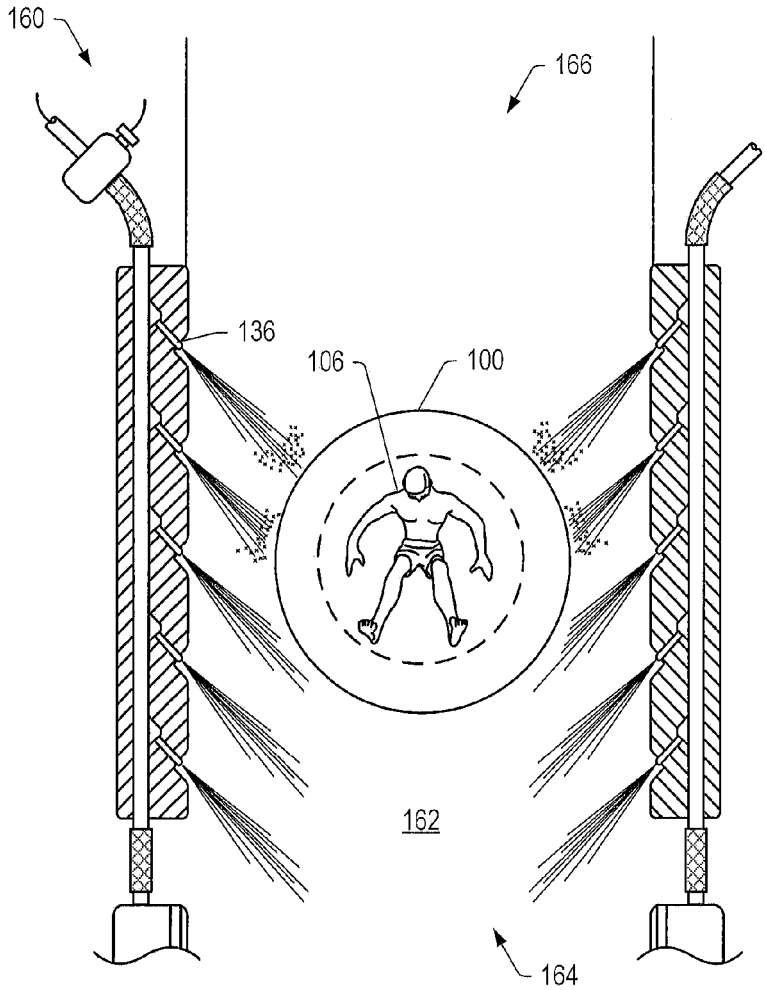
FIG. 30 depicts an embodiment of a floating queue line with jets.

In some embodiments, floating queue system 160 may include fluid jets. Floating queue system 160 may be designed as depicted in FIG. 30. A floating queue system may be coupled/positioned at a beginning point and/or ending point of an elevation system (e.g., conveyor belt elevation system 124) and/or amusement park ride. Fluid jets of a floating queue line may be used to assist in pushing participants and/or vehicles onto conveyor belts. In doing this, fluid jets will decrease the effort expended by a participant and increase a participant's amusement factor.

Fluid jets within a floating queue system may assist in controlling the flow of participants onto a conveyor system and/or amusement park ride. Control systems may be coupled to the fluid jets to control the velocity of fluids exiting the jets to control the flow of participants onto a conveyor system and/or amusement park ride. In some embodiments, control systems may be at least partially automated. For example, control systems may include sensors coupled to the control system. Sensors may assist the control system in keeping track of a participant flow rate through a floating queue system such that a control system may adjust the participant flow rate accordingly. The control system may be coupled to sensors at least in the immediate vicinity of the park preceding and following the floating queue. In some embodiments, a floating queue system may assist in controlling the flow of participants off a conveyor system and/or amusement park ride.

In some embodiments, one or more fluid jets may be designed to produce a fluid stream having a predetermined velocity which is selectively greater, less than, or the same as a velocity of a participant at each of the fluid jet locations. At least some of the fluid jets may be positioned along a portion of the first source of water and/or a portion of the second source of water substantially adjacent to a portion of the belt. The fluid jets may be oriented tangentially with respect to the surface of the source of water so as to contact a participant and/or participant vehicle as a participant and/or participant vehicle passes by each of the locations.

In some embodiments, an amusement park system may include portions of a body of water (e.g., channels, pools, etc.) wherein the portions are shallower than the rest of the body of water. Shallower portions of a body of water may allow participants to more easily enter the amusement park system at this point. Shallower portions may allow a participant to more easily enter a water amusement ride and/or more easily mount/access a vehicle (e.g., an inflatable vehicle such as an inner tube). Shallower portions of a body of water may also be referred to as participant/vehicle access or entrance points. These shallower portions may be shallow enough to facilitate participants entrance into a ride/vehicle while still allowing the participant/vehicle to float. In some embodiments, shallower portions of a body of water may range from 1 to 4 feet in depth. In some embodiments, shallower portions of a body of water may range from 1 to 3 feet in depth. In some embodiments, shallower portions of a body of water may range from 1 to 2 feet in depth. In some embodiments, shallower portions of a body of water may range from 2 to 3 feet in depth.

In some embodiments, shallower portions of a body of water may be positioned adjacent a beginning point and/or end point of an elevation system (e.g., a conveyor belt elevation system). Shallower portions may be positioned in conjunction with or instead of floating queue system 160 as depicted in FIG. 27 allowing participants to join the water amusement system at this point. As depicted in FIG. 27 multiple conveyor belt elevation systems may be joined together. Multiply branched elevation/channel systems as depicted in FIG. 29 may be introduced as part of a water amusement ride system and in specific embodiments may be positioned after floating queue system 160 as depicted in FIG. 27.

In some embodiments, shallower portions of a body of water may be positioned before/adjacent a beginning point of a conveyor belt elevation system. The shallower portion may be used in combination with means for conveying water from a beginning of a conveyor belt elevation system to the end of the conveyor belt elevation system, described more fully in U.S. Pat. No. 7,285,053. Water conveyed from a beginning point of a conveyor belt elevation system to an end point of a conveyor belt elevation system may be used to create a hydraulic gradient to assist in pushing a participant onto the conveyor belt and/or assist in pulling a participant off of the conveyor belt. The hydraulic gradient used in such a manner may assist in regulating the flow of participants through a conveyor belt elevation system as well as any water amusement park system to which the conveyor belt elevation system is a part of.

Figure 29:
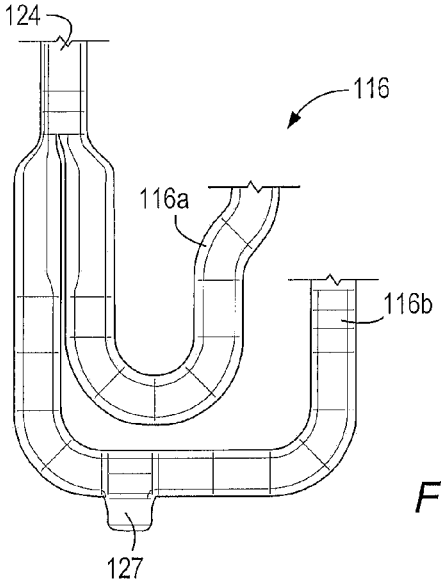
FIG. 29 depicts an embodiment of a portion of a path system of an amusement ride.

FIG. 29 depicts an embodiment of a portion of path system 116 of an amusement ride. Path system 116 may include several access points. An access point may include an entry/exit point of conveyor belt elevation system 124. Path system 116 may include access point 127. Access point 127 may include a point accessible by walking (e.g., stairs). Path system 116 may include path 116*a* and path 116*b*. FIG. 29 depicts how a path system may diverge and split allowing participants to choose different paths. Access points may include a mechanism to stabilize participant carriers.

In some embodiments, path 116*a* and/or path 116*b* may include a queue line which funnels participants in a controlled manner to conveyor belt elevation system 124. Using two or more queue lines to funnel participants to an elevation system (especially an elevation system which may handle several participants at a time (e.g., wide enough to handle two participants next to each other)) may increase the loading efficiency of an amusement ride.

In some embodiments, an elevation system may include a water lock system. These systems may be used to increase elevation and/or decrease elevation. In certain embodiments, an exit point of a first water ride of a continuous water ride may have an elevation below an entry point of a second water ride of the continuous water ride. In some embodiments, the water lock system includes a chamber for holding water coupled to the exit point of the first water ride and the entry point of the second water ride. A chamber is herein defined as an at least partially enclosed space. The chamber includes at least one outer wall, or a series of outer walls that together define the outer perimeter of the chamber. The chamber may also be at least partially defined by natural features such as the side of a hill or mountain. The walls may be substantially watertight. The outer wall of the chamber, in certain embodiments, extends below an upper surface of the first water ride and above the upper surface of the second water ride. The chamber may have a shape that resembles a figure selected from the group consisting of a square, a rectangle, a circle, a star, a regular polyhedron, a trapezoid, an ellipse, a U-shape, an L-shape, a Y-shape or a figure eight, when seen from an overhead view.

A first movable member may be formed in the outer wall of the chamber. The first movable member may be positioned to allow participants and water to move between the exit point of the first water ride and the chamber when the first movable member is open during use. A second movable member may be formed in the wall of the chamber. The second movable member may be positioned to allow participants and water to move between the entry point of the second water ride and the chamber when the second movable member is open during use. The second movable member may be formed in the wall at an elevation that differs from that of the first movable member.

In certain embodiments, the first and second movable members may be configured to swing away from the chamber wall when moving from a closed position to an open position during use. In certain embodiments, the first and second movable members may be configured to move vertically into a portion of the wall when moving from a closed position to an open position. In certain embodiments, the first and second movable members may be configured to move horizontally along a portion of the wall when moving from a closed position to an open position.

A bottom member may also be positioned within the chamber. The bottom member may be configured to float below the upper surface of water within the chamber during use. The bottom member may be configured to rise when the water in the chamber rises during use. In certain embodiments, the bottom member is substantially water permeable such that water in the chamber moves freely through the bottom member as the bottom member is moved within the chamber during use. The bottom member may be configured to remain at a substantially constant distance from the upper surface of the water in the chamber during use. The bottom member may include a wall extending from the bottom member to a position above the upper surface of the water. The wall may be configured to prevent participants from moving to a position below the bottom member. A floatation member may be positioned upon the wall at a location proximate the upper surface of the water. A ratcheted locking system may couple the bottom member to the inner surface of the chamber wall. The ratcheted locking system may be configured to inhibit the bottom member from sinking when water is suddenly released from the chamber. The ratcheted locking system may also include a motor to allow the bottom member to be moved vertically within the chamber. There may be one or more bottom members positioned within a single chamber. The bottom member may incorporate fluid jets to direct and/or propel participants in or out of the chamber.

The lock system may also include a substantially vertical first ladder coupled to the wall of the bottom member and a substantially vertical second ladder coupled to a wall of the chamber. The first and second ladders, in certain embodiments, are positioned such that the ladders remain substantially aligned as the bottom member moves vertically within the chamber. The second ladder may extend to the top of the outer wall of the chamber. The ladders may allow participants to exit from the chamber if the lock system is not working properly.

In certain embodiments, water may be transferred into and out of the water lock system via the movable members formed within the chamber wall. Opening of the movable members may allow water to flow into the chamber from the second water ride or out of the chamber into the first water ride.

The lock system may also include a controller for operating the system. The automatic controller may be a computer, programmable logic controller, or any other control device. The controller may be coupled to the first movable member, the second movable member, and the first water control system. The controller may allow manual, semi-automatic, or automatic control of the lock system. The automatic controller may be connected to sensors positioned to detect if people are in the lock or not, blocking the gate, or if the gate is fully opened or fully closed or the water levels within the chambers.

In certain embodiments, the participants may be floating in water during the entire transfer from the first water ride to the second water ride. The participants may be swimming in the water or floating upon a floatation device. Preferably, the participants are floating on an inner tube, a floatation board, raft, or other floatation devices used by participants on water rides.

In certain embodiments, the lock system may include multiple movable members formed within the outer wall of the chamber. These movable members may lead to multiple water rides and/or continuous water ride systems coupled to the chamber. The additional movable members may be formed at the same elevational level or at different elevations.

In some embodiments, a first and second movable members formed in the outer wall of a chamber of a lock system may be configured to move vertically into a portion of the wall when moving from a closed position to an open position. The members may be substantially hollow, and have holes in the bottom configured to allow fluid flow in and out of the member. In an open position, the hollow member may be substantially filled with water. To move the member to a closed position, compressed air from a compressed air source may be introduced into the top of the hollow member through a valve, forcing water out of the holes in the bottom of the member. As the water is forced out and air enters the member, the buoyancy of the member may increase and the member may float up until it reaches a closed position. In this closed position, the holes in the bottom of the member may remain submerged, thereby preventing the air from escaping through the holes. To move the member back to an open position, a valve in the top of the member may be opened, allowing the compressed air to escape and allowing water to enter through the holes in the bottom. As water enters and compressed air escapes, the gate may lose buoyancy and sink until it reaches the open position, when the air valve may be closed again.

An advantage to the pneumatic gate system may be that water may be easily transferred from a higher lock to a lower one over the top of the gate. This system greatly simplifies and reduces the cost of valves and pumping systems between lock levels. The water that progressively spills over the top of the gate as it is lowered is at low, near-surface pressures in contrast to water pouring forth at various pressures in a swinging gate lock system. This advantage makes it feasible to eliminate some of the valves and piping required to move water from a higher lock to a lower lock.

In certain embodiments a pneumatic or hydraulic cylinder may be used to vertically move a gate system. An advantage to this system may be that the operator has much more control over the gate than with a gate system operating on a principle of increasing and decreasing the buoyancy. More control of the gate system may allow the gates to be operated in concert with one another, as well as increasing the safety associated with the system. The gate may be essentially hollow and filled with air or other floatation material such as Styrofoam, decreasing the power needed to move the gate.

While water lock systems are described as having only a single chamber coupled to two water rides forming an amusement ride, it should be understood that multiple chambers may be interlocked to couple two or more water rides of a first amusement ride and/or a second amusement ride. By using multiple chambers, a series of smaller chambers may be built rather than a single large chamber. In some situations it may be easier to build a series of chambers rather than a single chamber. For example, use of a series of smaller chambers may better match the slope of an existing hill. Another example is to reduce water depths and pressures operating in each chamber so as to improve safety and reduce structural considerations resulting from increased water pressure differentials. Another example is the use of multiple chambers to increase aesthetics or ride excitement. Another is the use of multiple chambers to increase overall speed and participant throughput of the lock.

The participants may be transferred from the first water ride to the second water ride by entering the chamber and altering the level of water within the chamber. The first movable member, coupled to the first water ride is opened to allow the participants to move into the chamber. The participants may propel themselves by pulling themselves along by use of rope or other accessible handles or be pushed directly with fluid jets or be propelled by a current moving from the lower water ride toward the chamber. The current may be generated using fluid jets positioned along the inner surface of the chamber. Alternatively, a current may be generated by altering the level of water in the first water ride. For example, by raising the level of water in the first water ride a flow of water from the first water ride into the chamber may occur.

After the participants have entered the chamber, the first movable member is closed and the level of water in the chamber is altered. The level may be raised or lowered, depending on the elevation level of the second water ride with respect to the first water ride. If the second water ride is higher than the first water ride, the water level is raised. If the first water ride is at a higher elevation than the second water ride, the water level is lowered. As the water level in the chamber is altered, the participants are moved to a level commensurate with the upper surface of the second water ride. While the water level is altered within the chamber, the participants remain floating proximate the surface of the water. A bottom member preferably moves with the upper surface of the water in the chamber to maintain a relatively constant and safe depth of water beneath the participants. The water level in the chamber, in certain embodiments, is altered until the water level in the chamber is substantially equal to the water level of the second water ride. The second movable member may now be opened, allowing the participants to move from the chamber to the second water ride. In certain embodiments, a current may be generated by filling the chamber with additional water after the level of water in the chamber is substantially equal to the level of water outside the chamber. As the water is pumped in the chamber, the resulting increase in water volume within the chamber may cause a current to be formed flowing from the chamber to the water ride. When the movable member is open, the formed current may be used to propel the participants from the chamber to a water ride. Thus, the participants may be transferred from a first water ride to a second water ride without having to leave the water forming an amusement ride. The participants are thus relieved of having to walk up a hill. The participants may also be relieved from carrying any floatation devices necessary for the amusement ride. Water lock systems may be more fully described in U.S. Pat. No. 7,285,053 and U.S. Pat. No. 6,475,095 which are all incorporated by reference herein.

In some embodiments, elevation systems may be designed to be entertaining and an enjoyable part of the water ride as well as the water rides of the amusement ride which the elevation system is connecting. For example, when the elevation system includes an uphill water slide, the entertainment value may be no less for the elevation system of the continuous water ride than for the connected water rides.

In some embodiments, an exit point of a second water ride of an amusement ride may be coupled to an entry point of a first water ride. Coupling the exit point of the second water ride to the entry point of the first water ride may form a true continuous water ride loop. The continuous water ride may include a second elevation system coupling the exit point of the second water ride to the entry point of the first water ride. The second elevation system may include any of the elevation systems described for use in coupling an exit point of the first water ride to the entry point of the second water ride. The second elevation system may be a different elevation system than the first elevation system. For example, the first elevation system may be an uphill water slide and the second water elevation system may be a conveyor belt system.

In some embodiments, a continuous water ride may include one or more floating queue lines. Floating queue lines may be more fully described in U.S. Pat. No. 7,285,053. Floating queue lines may assist in coupling different portions of a continuous water ride. Floating queue line systems may be used for positioning participants in an orderly fashion and delivering them to the start of a ride at a desired time. In certain embodiments, this system may include a channel (horizontal or otherwise) coupled to a ride on one end and an elevation system on the other end. It should be noted, however, that any of the previously described elevation systems may be coupled to the water ride by the floating queue line system. Alternatively, a floating queue line system may be used to control the flow of participants into the continuous water ride from a dry position within a station.

In use, participants desiring to participate on a water ride may leave the body of water and enter the floating queue line. The floating queue line may include pump inlets and outlets similar to those in a horizontal channel but configured to operate intermittently to propel participants along the queue line, or the inlet and outlet may be used solely to keep a desired amount of water in the queue line. In the latter case, the channel may be configured with high velocity low volume jets that operate intermittently to deliver participants to the end of the queue line at the desired time.

In certain embodiments, the water moves participants along the floating queue line down a hydraulic gradient or bottom slope gradient. The hydraulic gradient may be produced by out-flowing the water over a weir at one end of the queue after the participant enters the ride to which the queue line delivers them, or by out-flowing the water down a bottom slope that starts after the point that the participant enters the ride. In certain embodiments, the water moves through the queue channel by means of a sloping floor. The water from the outflow of the queue line in any method can reenter the main channel, another ride or water feature, or return to the system sump. Preferably the water level and width of the queue line are minimized for water depth safety, participant control and water velocity. These factors combined deliver the participants to the ride in an orderly and safe fashion, at the preferred speed, with minimal water volume usage. The preferred water depth, channel width and velocity would be set by adjustable parameters depending on the type of inflatable vehicle, participant comfort and safety, and water usage. Decreased water depth may also be influenced by local ordinances that determine level of operator or lifeguard assistance, the preferred being a need for minimal operator assistance consistent with safety.

In some embodiments, amusement rides may include exits or entry points at different portions of the amusement ride. Floating queue lines coupling different portions and/or rides forming an amusement ride may include exit and/or entry points onto the continuous water ride. Exit/entry points may be used for emergency purposes in case of, for example, an unscheduled shutdown of the amusement water ride. Exit/entry points may allow participants to enter/exit the amusement water ride at various designated points along the ride during normal use of the amusement water ride. Participants entering/exiting the continuous water ride during normal use of the ride may not disrupt the normal flow of the ride depending on where the entry/exit points are situated along the course of the ride.

Embodiments disclosed herein provide an interactive control system for an amusement ride and/or portions of the amusement ride. In certain embodiments, the control system may include a programmable logic controller. The control system may be coupled to one or more activation points, participant detectors, and/or flow control devices. In addition, one or more other sensors may be coupled to the control system. The control system may be utilized to provide a wide variety of interactive and/or automated water features. In some embodiments, participants may apply a participant signal to one or more activation points. The activation points may send activation signals to the control system in response to the participant signals. The control system may be configured to send control signals to a water system, a light system, and/or a sound system in response to a received activation signal from an activation point. A water system may include, for example, a water effect generator, a conduit for providing water to the water effect generator, and a flow control device. The control system may send different control signals depending on which activation point sent an activation signal. The participant signal may be applied to the activation point by the application of pressure, moving a movable activating device, a gesture (e.g., waving a hand), interrupting a light beam, a participant identifier and/or by voice activation. Examples of activation points include, but are not limited to, hand wheels, push buttons, optical touch buttons, pull ropes, paddle wheel spinners, motion detectors, sound detectors, and levers.

The control system may be coupled to sensors to detect the presence of a participant proximate to the activation point. The control system may be configured to activate a water system, sound system, and/or light system in response to a detection signal indicating that a participant is proximate to an activation point. The control system may also be coupled to flow control devices, such as, but not limited to: valves and pumps. Valves may includes air valves and water valves configured to control the flow of air or water, respectively, through a water feature. The control system may also be coupled to one or more indicators located proximate to one or more activation points. The control system may be configured to generate and send indicator control signals to turn an indicator on or off. The indicators may signal a participant to apply a participant signal to an activation point associated with each indicator. An indicator may signal a participant via a visual, audible, and/or tactile signal. For example, an indicator may include an image projected onto a screen.

In some embodiments, the control system may be configured to generate and send one or more activation signals in the absence of an activation signal. For example, if no activation signal is received for a predetermined amount of time, the control system may produce one or more control signals to activate a water system, sound system, and/or light system.

Throughout the system electronic signs or monitors may be positioned to notify participants or operators of various aspect of the system including, but not limited to: operational status of any part of the system described herein above; estimated waiting time for a particular ride; and possible detours around non operational rides or areas of high participant density.

In some embodiments, a water amusement park may include a cover or a screen. Screens may be used to substantially envelope or cover a portion of a water amusement park. Portions of the screen may be positionable. Positionable screen portions may allow portions of the park to be covered or uncovered. The decision to cover or uncover a portion of the water amusement park may be based on the weather. Inclement weather may prompt operators to cover portions of the waterpark with the positionable screens. While clear warm weather may allow operators to move the positionable screen so portions of the water amusement park remain uncovered.

In some embodiments, positionable screens may be formed from substantially translucent materials. Translucent materials may allow a portion of the visible light spectrum to pass through the positionable screens. Translucent materials may inhibit transmittance of certain potentially harmful portions of the light spectrum (e.g., ultraviolet light). Filtering out a potentially harmful portion of the light spectrum may provide added health benefits to the water amusement park relative to uncovered water amusement parks. A non-limiting example of possible screen material may include Foiltech. Foiltech has an R protective value of about 2.5. A non-limiting example of possible screen material may include polycarbonates. Polycarbonates may have an R protective value of about 2. In some embodiments, multiple layers of screen material (e.g., polycarbonate) may be used. Using multiple layers of screen material may increase a screen materials natural thermal insulating abilities among other things. Portions of the screening system described herein may be purchased commercially at Arqualand in the United Kingdom.

In some embodiments, portions of the positionable screen may assist in collecting solar radiation. Solar radiation collected by portions of the positionable screen may be used to increase the ambient temperature in the area enclosed by the screen. Increasing the ambient temperature in enclosed portions of the water amusement park using collected solar radiation may allow the water amusement park to remain open to the public even when the outside temperature is uncomfortably cold and unconducive to typical outside activities.

In some embodiments, positionable screens may be used to enclose portions of a water amusement park. Enclosed areas of the water amusement park may function as a heat sink. Heat emanating from bodies of water within the enclosed area of the water amusement park may be captured within the area between the body of water and the positionable screens. Heat captured under the positionable screens may be recirculated back into the water. Captured heat may be recirculated back into the water using heat pumps and/or other common methods known to one skilled in the art.

In some embodiments, screens may be mounted on wheels and/or rollers. Screen may be formed from relatively light but strong materials. For example, panels may be formed from polycarbonate for other reasons described herein, while structural frameworks supporting these panels may be formed from, for example, aluminum. Lightweight, well-balanced, support structures on wheels/rollers might allow screens to be moved manually by only a few operators. Operators might simply push screens into position. Mechanisms may installed to assist operators in manually positioning screens (e.g., tracks, pulley mechanisms).

Examples of systems which facilitate movement of screens over bodies of water and/or channels (e.g., track based systems) are illustrated in U.S. Pat. No. 4,683,686 to Ozdemir and U.S. Pat. No. 5,950,253 to Last, each of which is incorporated by reference as if fully set forth herein.

In some embodiments, some water amusement park areas may include immovable screens substantially enclosing the water amusement area (e.g., a dome structure). While other water amusement areas may remain uncovered year round. Channels may connect different water amusement areas. Channels may include portions of a natural river. Channels may include portions of man-made rivers or reservoirs. Channels may include portions of a natural or man-made body of water (e.g., a lake). The portions of the natural or man-made body of water may include artificial or natural barriers to form a portion of the channel in the body of water. Channels may include positionable screens as described herein. In some embodiments, an entire waterpark may include permanent and/or positionable screens covering the waterpark. In some embodiments, only portions of a waterpark may include permanent and/or positionable screens.

There are advantages to covering the channels and/or portions of the park connected by the channels as opposed to covering the entire park in, for example, one large dome. One advantage may be financial, wherein enclosing small portions and/or channels of a park is far easier from an engineering standpoint and subsequently much cheaper than building a large dome. Channels that extend for relatively long distances may be covered far more easily than a large dome structure extending over the same distance which covers the channel and much of the surrounding area. It is also far easier to retract portions of the screens described herein to selectively expose portions of a waterpark than it is to selectively retract portions of a dome.

Screen systems may be more fully described in U.S. patent application Ser. No. 10/693,654 to Henry et al. which is incorporated by reference as if fully set forth herein.

In some embodiments, water amusement parks may include participant identifiers. Participant identifiers may be used to locate and/or identify one or more participants at least inside the confines of the water amusement park. Participant identifiers may assist control systems in the water amusement park. Participant identifiers may be considered as one portion of a water amusement park control system in some embodiments. Participant identifiers may be used for a variety of functions in the water amusement park.

In some embodiments, a plurality of personal identifiers may be used in combination with a water amusement park. Personal identifiers may be provided to each individual participant of the water amusement park. Personal identifiers may be provided for each member of staff working at the water amusement park. Within the context of this application the term "participant" may include anyone located in the confines of the water amusement park including, but not limited to, staff and/or patrons. A plurality of sensors may be used in combination with the personal identifiers. Personal identifiers may function as personal transmitters. Sensors may function as receiver units. Sensors may be positioned throughout the water amusement park. Sensor may be positioned, for example, at particular junctions (i.e., coupling points) along, for example, a continuous water ride. Sensors may be placed along, for example, floating queue lines, channels, entry/exit points along water rides, and/or entry/exit points between portions of the water amusement park. Personal identifiers working in combination with sensors may be used to locate and/or identify participants.

In some embodiments, personal identifiers and/or sensors may be adapted for ultrasonic, or alternatively, for radio frequency transmission. Personal identifiers and/or sensors may operate on the same frequency. Identification of individual personal identifiers may be achieved by a pulse timing technique whereby discrete time slots are assigned for pulsing by individual units on a recurring basis. Pulses received from sensors may be transmitted to decoder logic which identifies the locations of the various transmitter units in accordance with the time interval in which pulses are received from various sensors throughout the water amusement park. A status board or other display device may display the location and/or identity of the participant in the water amusement park. Status of a participant may be displayed in a number of ways. Status of a participant may be displayed as some type of icon on a multi-dimensional map. Status of a participant may be displayed as part of a chart displaying throughput for a portion of the water amusement park.

In some embodiments, programming means may be provided for a participant identifier. Participant identifiers may be substantially identical in construction and electronic adjustment. Participant identifiers may be programmed to predetermined pulse timing slots by the programming means. Any participant may use any participant identifier. The particular pulse timing slot may be identified as corresponding with a particular participant using a programmer. Participant identifiers may be associated with a particular participant by positioning the participant identifier in a receptacle. The receptacle may be coupled to the programmer. Receptacles may function to recharge a power source powering the participant identifier. In some embodiments, a receptacle may not be necessary and the personal identifier may be associated in the water amusement park with a particular participant via wireless communication between the personal identifier and a programmer.

In some embodiments, participant identifiers may be removably coupled to a participant. The participant identifier may be band which may be coupled around an appendage of a participant. The band may be attached around, for example, an arm and/or leg of a participant. In some embodiments, identifiers may include any shape. Identifiers may be worn around the neck of a participant much like a medallion. In some embodiments, an identifier may be substantially attached directly to the skin of a participant using an appropriate adhesive. In some embodiments, an identifier may be coupled to an article of clothing worn by a participant. The identifier may be coupled to the article of clothing using, for example, a "safety pin", a plastic clip, a spring clip, and/or a magnetic based clip. In some embodiments, identifiers may be essentially "locked" after coupling the identifier to a participant. A lock may inhibit the identifier from being removed from the participant by anyone other than a staff member except under emergency circumstances. Locking the identifier to the participant may inhibit loss of identifiers during normal use of identifiers. In some embodiments, a participant identifier may be designed to detach from a participant under certain conditions. Conditions may include, for example, when abnormal forces are exerted on the participant identifier. Abnormal forces may result from the participant identifier becoming caught on a protrusion, which could potentially endanger the participant.

In some embodiments, circuitry and/or a power source may be positioned substantially in the personal identifiers. Positioning any delicate electronics in the personal identifier, such that material forming the personal identifier substantially envelopes the electronics, may protect sensitive portions of the personal identifier from water and/or corrosive chemicals typically associated with a water amusement park. Participant identifiers may be formed from any appropriate material. Appropriate materials may include materials that are resistant to water and corrosive chemicals typically associated with a water amusement park. Participant identifiers may be at least partially formed from materials which are not typically thought of as resistant to water and/or chemicals, however, in some embodiments materials such as these may be treated with anticorrosive coatings. In certain embodiments, participant identifiers may be formed at least partially from polymers.

In some embodiments, a personal identifier may be brightly colored. Bright colors may allow the identifier to be more readily identified and/or spotted. For example, if the identifier becomes decoupled from a participant the identifier may be more easily spotted if the identifier is several feet or more under water. In some embodiments, a personal identifier may include a fluorescent dye. The dye may be embedded in a portion of the personal identifier. The dye may further assist in spotting a lost personal identifier under water and/or under low light level conditions (e.g., in a covered water slide).

Personal identifiers which may be adapted to be used with the systems and methods described herein are more fully described in U.S. patent application Ser. No. 10/693,654 to Henry et al which is incorporated by reference herein.

Other components which may be incorporated into a participant identifier system are disclosed in the following U.S. Patents, herein incorporated by reference: a personal locator and display system as disclosed in U.S. Pat. No. 4,225,953; a personal locator system for determining the location of a locator unit as disclosed in U.S. Pat. No. 6,362,778; a low power child locator system as disclosed in U.S. Pat. No. 6,075,442; a radio frequency identification device as disclosed in U.S. Pat. No. 6,265,977; and a remote monitoring system as disclosed in U.S. Pat. No. 6,553,336.

In some embodiments, participant identifiers may be used as part of an automated safety control system. Participant identifiers may be used to assist in determining and/or assessing whether a participant has been separated from their vehicle (e.g., inflatable vehicles or inner tubes). Sensors may be positioned along portions of a water amusement park. For example sensors may be placed at different intervals along a water amusement ride. Intervals at which sensors are placed may be regular or irregular. Placement of sensors may be based on possible risk of a portion of a water amusement ride. For example, sensors may be placed with more frequency along faster moving portions of a water amusement ride where the danger for a participant to be separated from their vehicle is more prevalent.

In some embodiments, vehicle identifiers may be used to identify a vehicle in a water amusement park. The vehicle identifier may be used to identify the location of the vehicle. The vehicle identifier may be used to identify the type of vehicle. For example, the vehicle identifier may be used to identify how many people may safely ride in the vehicle.

In some embodiments, sensors near an entry point of a portion of a water amusement ride may automatically assess a number of participant identifiers/participants associated with a particular vehicle. Data such as this may be used to assess whether a participant has been separated from their vehicle in another portion of the water amusement ride.

In some embodiments, an operator may manually input data into a control system. Data input may include associating particular participant identifier(s) and/or the number of participants with a vehicle.

In some embodiments, a combination of automated and manual operation of a safety control system may be used to initially assess a number of participants associated with a vehicle. For example, an operator may provide input to initiate a sensor or a series of sensors to assess the number of participants associated with the vehicle. The assessment may be conducted at an entry point of a water amusement ride.

In certain embodiments, personal identifiers may be used in combination with a recording device. The recording device may be positioned in a water amusement park. One or more recording devices may be used throughout the water amusement park. The participant identifier may be used to activate the recording device. The participant identifier may be used to remotely activate the recording device. The recording device may include a sensor as described herein. The identifier may automatically activate the recording device upon detection by the sensor coupled to the recording device. The participant may activate the recording device by activating the personal identifier using participant input (e.g., a mechanical button, a touch screen). The participant identifier may activate one or more recording devices at one or more different times and/or timing sequences. For example several recording devices may be positioned along a length of a downhill slide. A participant wearing a personal identifier may activate (automatically or upon activation with user input) a first recording device positioned adjacent an entry point of the slide. Activating the first recording device may then activate one or more additional recording devices located along the length of the downhill water slide. Recording devices may be activated in a particular sequence so as to record the participant progress through the water slide.

In some embodiments, a recording device may record images and/or sound. The recording device may record other data associated with recorded images and/or sound. Other data may include time, date, and/or information associated with a participant wearing a participant identifier. The recording device may record still images and/or moving (i.e., short movie clips). Examples of recording devices include, but are not limited to, cameras and video recorders.

In some embodiments, a recording device may be based on digital technology. The recording device may record digital images and/or sound. Digital recording may facilitate storage of recorded events, allowing recorded events to be stored on magnetic media (e.g., hard drives, floppy disks, etc . . . ). Digital recordings may be easier to transfer as well. Digital recordings may be transferred electronically from the recording device to a control system and/or processing device. Digital recordings may be transferred to the control system via a hard-wired connection and/or a wireless connection.

Upon recording an event, the recording device may transfer the digital recording to the control system. The participant may purchase a copy of the recording as a souvenir. The participant may purchase a copy while still in a water amusement park, upon exiting the water amusement park, and/or at a later date. The control system may print a hard copy of the digital recording. The control system may transfer an electronic copy of the recorded event to some other type of media that may be purchased by the participant to take home with them. The control system may be connected to the Internet. Connecting the control system to the Internet may allow a participant to purchase a recorded event through the Internet at a later time. A participant may be able to download the recorded event at home upon arranging for payment.

In some embodiments, personal identifiers may be used in combination with sensors to locate a position of a participant in a water amusement park. Sensors may be positioned throughout the waterpark. The sensors may be connected to a control system. Locations of sensors throughout the waterpark may be programmed into the control system. The participant identifier may activate one of the sensors automatically when it comes within a certain proximity of the sensor. The sensor may transfer data concerning the participant (e.g., time, location, and/or identity) to the control system.

In some embodiments, participant identifiers may be used to assist a participant to locate a second participant. For example, identifiers may assist a parent or guardian to locate a lost child. The participant may consult an information kiosk or automated interactive information display. The interactive display may allow the participant to enter a code, name, and/or other predetermined designation for the second participant. The interactive display may then display the location of the second participant to the participant. The location of the second participant may be displayed, for example, as an icon on a map of the park. Security measures may be taken to ensure only authorized personnel are allowed access to the location of participants. For example, only authorized personnel (e.g., waterpark staff) may be allowed access to interactive displays and/or any system allowing access to identity and/or location data for a participant. Interactive displays may only allow participants from a predetermined group access to participant data from their own group.

In some embodiments, participant identifier may be used to assist in regulating throughput of participants through portions of a water amusement park. Participant identifiers may be used in combination with sensors to track a number of participants through a portion of the water amusement park. Keeping track of numbers of participants throughout the waterpark may allow adjustments to be made to portions of the waterpark. Adjustments made to portions of the waterpark may allow the portions to run more efficiently. Adjustments may be at least partially automated and carried out by a central control system. Increasing efficiency in portions of the waterpark may decrease waiting times for rides.

In some embodiments, sensors may be positioned along one or both sides of a floating queue line. Sensors in floating queue lines may be able to assist in detecting participants wearing participant identifiers. Data about participants in the floating queue lines may be transferred to a control system. Data may include a number of participants, identity of the participants, and/or speed of the participants through the floating queue lines. Based on data collected from the sensors, a control system may try to impede or accelerate the speed and/or throughput of participants through the floating queue line as described herein. Adjustment of the throughput of participants through the floating queue lines may be fully or partially automated. As numbers of participants in a particular ride increase throughput may decrease. In response to data from sensors the control system may increase the flow rate of participants to compensate. The control system may automatically notify waterpark staff if the control system is not able to compensate for increased flow rate of participants.

In certain embodiments (an example of which is depicted in FIG. 30), floating queue system 160 includes a queue channel 162 coupled to a water ride at a discharge end 164 and coupled to a transportation channel on the input end 166. The channel 162 contains enough water to allow participants to float in the channel 162. The channel 162 additionally comprises high velocity low volume jets 136 located along the length of the channel 162. The jets are coupled to a source of pressurized fluid (not shown). Participants enter the input end 166 of the queue channel 162 from the coupled transportation channel, and the jets 136 are operated intermittently to propel the participant along the channel at a desired rate to the discharge end 164. This rate may be chosen to match the minimum safe entry interval into the ride, or to prevent buildup of participants in the queue channel 162. The participants are then transferred from the queue channel 162 to the water ride, either by a sheet flow lift station (as described previously) or by a conveyor system (also described previously) without the need for the participants to leave the water and/or walk to the ride. Alternatively, propulsion of the participants along the channel 162 may be by the same method as with horizontal hydraulic head channels; that is, by introducing water into the input end 166 of the channel 162 and removing water from the discharge end 164 of the channel 162 to create a hydraulic gradient in the channel 162 that the participants float down. In this case, the introduction and removal of water from the channel 162 may also be intermittent, depending on the desired participant speed.

In some embodiments, a queue system may include water deep enough to substantially float buoyant vehicles. The queue system may include fluid jets located along the length of a path system forming the queue system. The fluid jets may include high velocity low volume fluid jets. The jets may use pressurized or high velocity fluids directed at participants/vehicles to propel them along a surface. The surface may include an incline, a decline, or be substantially level. Fluids may include liquids (e.g., water) and/or gases (e.g., air). Jets may be set at an appropriate angle to provide propulsive power for a vehicle. Jets may automatically orient themselves to a proper angle when connected to an automated control system. Jets may be positioned along floors, walls, and/or ceilings. Fluid jets using liquids to propel participant carriers along a portion of a water path system may be used in combination with dewatering systems. Dewatering systems may be especially useful when fluid jets using liquids are used to propel participant carriers up an incline. Dewatering systems may be used to remove liquid running down an inclined surface, such that the momentum of the liquid does not detract from the momentum of fluid expelled from fluid jets used to propel participants. Dewatering systems may be more fully described in U.S. Pat. No. 5,011,134 which is incorporated by reference herein.

Fluid jet systems used for vehicle propulsion in amusement rides may be more fully described in U.S. Pat. No. 5,213,547 to Lochtefeld and U.S. Pat. No. 5,503,597 to Lochtefeld et al. which are incorporated by reference as if fully set forth herein.

In some embodiments, participant identifiers may be used with interactive games. Interactive games may include interactive water games. Interactive games may be positioned anywhere in a water amusement park. Interactive games may be positioned along a floating queue line, an elevation system, and/or a water ride. Interactive games positioned along portions of the water amusement park where delays are expected may make waiting more tolerable or even pleasurable for participants.

An interactive water game including a control system as described above may include a water effect generator; and a water target coupled to the control system. In some embodiments, the water effect generator may include a water cannon, a nozzle, and/or a tipping bucket feature. The water effect generator may be coupled to a play structure. During use a participant may direct the water effect generator toward the water target to strike the water target with water. A participant may direct the water effect using a participant identifier to activate the water effect generator. Upon being hit with water, the water target may send an activation signal to the control system. Upon receiving an activation signal from the water target, the control system may send one or more control signals to initiate or cease predetermined processes.

The water target may include a water retention area, and an associated liquid sensor. In some embodiments, the liquid sensor may be a capacitive liquid sensor. The water target may further include a target area and one or more drains. The water target may be coupled to a play structure.

In some embodiments, the interactive water game may include one or more additional water effect generators coupled to the control system. Upon receiving an activation signal from the water target, the control system may send one or more control signals to the additional water effect generator. The additional water effect generator may be configured to create one or more water effects upon receiving the one or more control signals from the control system. For example, the one or more water effects created by the additional water effect generator may be directed toward a participant. The additional water effect generator may include, but is not limited to: a tipping bucket feature, a water cannon, and/or a nozzle. The additional water effect generator may be coupled to a play structure.

A method of operating an interactive water game may include applying a participant signal to an activation point associated with a water system. The participant signal may be fully automated and originate from a participant identifier. The participant signal may be activated when a participant wearing the participant identifier positions themselves in predetermined proximity of the activation point. Participant input may activate the participant signal using the participant identifier. An activation signal may be produced in response to the applied participant signal.

The activation signal may be sent to a control system. A water system control signal may be produced in the control system in response to the received activation signal. The water system control signal may be sent from the control system to the water system. The water system may include a water effect generator. The water effect generator may produce a water effect in response to the water system control signal. The water effect generator may be directed toward a water target to strike the water target with water. An activation signal may be produced in the water target, if the water target is hit with water. The water target may send the activation signal to the control system. A control signal may be produced in the control system in response to the received water target activation signal. In some embodiments, the interactive water game may include an additional water effect generator. The control system may direct a control signal to the additional water effect generator if the water target is struck by water. The additional water effect generator may include, but is not limited to: a water cannon, a nozzle, or a tipping bucket feature. The additional water effect generator may produce a water effect in response to a received control signal. The water effect may be directed toward a participant.

Amusement rides including water channels (e.g., artificial rivers) may include adjustable mechanisms or devices capable of changing the course of a river. Adjustable mechanisms such as these may be described as adjustable weirs. Weirs are generally defined as a dam placed across a river or canal to raise or divert the water, or to regulate or measure the flow of water.

A mechanism is described that controls the flow of water for an artificial river, in the context of a waterpark, and in the setting of participants and participant carriers within the controlled river. Adjustable weirs may be optimally producible, easily installed, and/or readily maintained. Safety to both participants and personnel may be a requirement. Adjustable weirs may function to alter flow characteristics of water in a channel, produce downstream rapids of varying degree, and/or undulations to such in dynamic fashion. Adjustable weirs may function to fully dam up the upstream body of water (with only moderate leakage), whether in off-duty mode and/or in the event of power failure, such that, for example, upper water volumes may not overflow lower regions of the same river system.

Adjustable weirs may include safety fail-safes. For example an adjustable weir may include a loss of power mode, where the weir reverts to/maintains an upward (water-retaining) position. Adjustable weir fail-safes may include keeping gaps between static and moving features to a safe minimum, and/or inherently precluding access. Adjustable weir fail-safes may include ensuring no serviceable equipment (except for fundamental overhaul, coinciding with river drainage) may be located behind or beneath the primary mechanism. Advantages of ensuring no serviceable equipment is located behind or beneath the primary mechanism may ensure accessibility to serviceable equipment (e.g., when in the failsafe position, a huge body of water may be under retention). Serviceable equipment and/or motive components may be located outboard of the main channel, whether below grade (e.g., in pits), and/or above (e.g., in enclosures).

Adjustable weirs may include serviceable equipment and components which may be removed/exchanged with comparative rapidity and minimal disruption/removal of other components. Adjustable weirs may require minimal maintenance. Adjustable weirs may include drive mechanisms which are chemically benign (e.g., electrical or pneumatic). Chemically benign drive mechanisms are advantageous when river systems (natural or artificial) are used so as to inhibit introduction of chemicals (e.g., hydraulic fluid) into the environment. Non-engineered parts may be used whenever possible for the construction of adjustable weirs, chosen at least for durability and ready availability. Adjustable weirs may include lock-out features, such that the weir table may be redundantly secured into either of its extreme positions, regardless of hydraulic conditions in the river. An adjustable weir may be capable of dynamic operation, taking into account the changing hydraulic forces of the moving volume of water.

Figure 31:
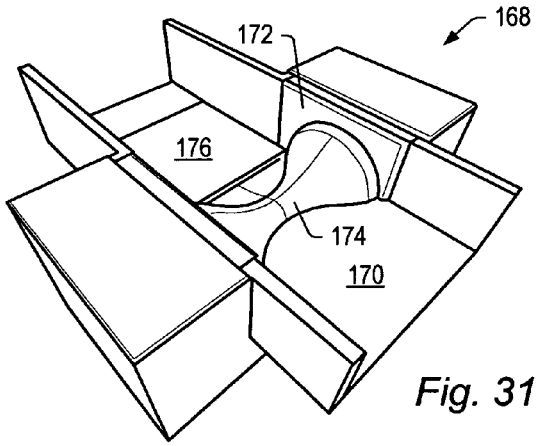
FIG. 31 depicts a perspective view of an embodiment of an adjustable weir in a powered down state in a portion of a water channel of an amusement ride.

FIG. 31 depicts a perspective view of an embodiment of adjustable weir 168 in a powered down state in a portion of a water channel of an amusement ride. In general, a "relaxed" state of a channel (e.g., river) may be in fact the fully powered-down state of weir 168. In this position, water is flowed over the minimal profile, causing downstream turbulence. Participants, float at some distance above, having minimal or no contact with the surfaces portrayed in FIG. 31.

Closing the gaps are fixed upstream plate 170 (secured to the concrete riverbed), and side shrouds 172. Both elements may continuously fit to rotatable contour 174, regardless of its position. The rotatable contour depicted in the associated figures is in the shape of an "hourglass," however it should be noted this is just one example of many possible shapes the rotatable contour may assume.

Figure 32:
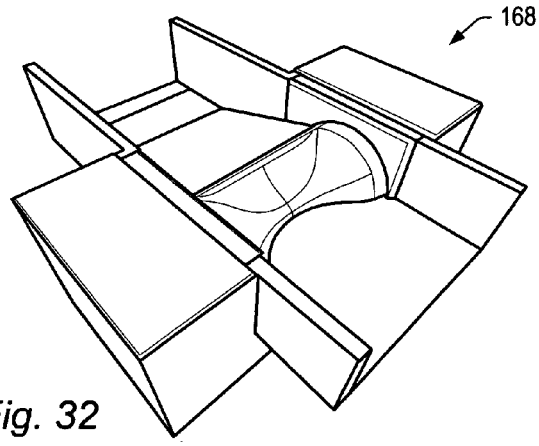
FIG. 32 depicts a perspective view of an embodiment of an adjustable weir in a 50% retracted state in a portion of a water channel of an amusement ride.

FIG. 32 depicts a perspective view of an embodiment of adjustable weir 168 in a 50% retracted state in a portion of a water channel of an amusement ride. With an adjustable weir 50% retracted, serious downstream turbulence may be introduced. Participants may be shot over a raised stream, from a body of water by the weir, into a high-velocity condition.

To prevent water and/or participants from being sucked down behind adjustable weir 168, trailing plates 176 may be attached to the pivoting weir table. An upstream leaf is hinged directly thereto; a horizontal plate may be dragged behind. Together, a benign (though moving) riverbed is presented, with close proximity to the concrete walls (and minimal gaps).

Figure 33:
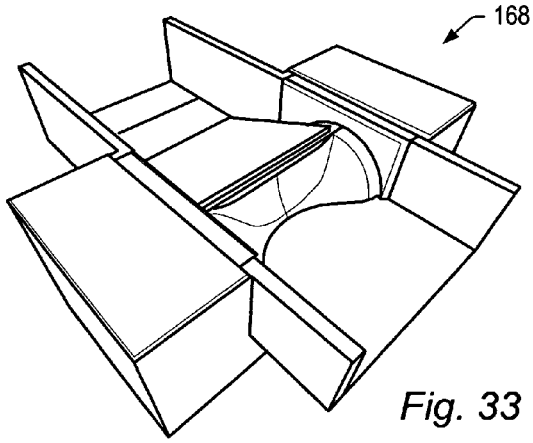
FIG. 33 depicts a perspective view of an embodiment of an adjustable weir in a fully retracted state in a portion of a water channel of an amusement ride.

FIG. 33 depicts a perspective view of an embodiment of adjustable weir 168 in a fully retracted state in a portion of a water channel of an amusement ride. When the weir is fully retracted, for off-hours, maintenance duty, or power failure, its de-energized position is fully vertical. Water flow is prevented, with the weir effectively being a dam.

Figure 34:
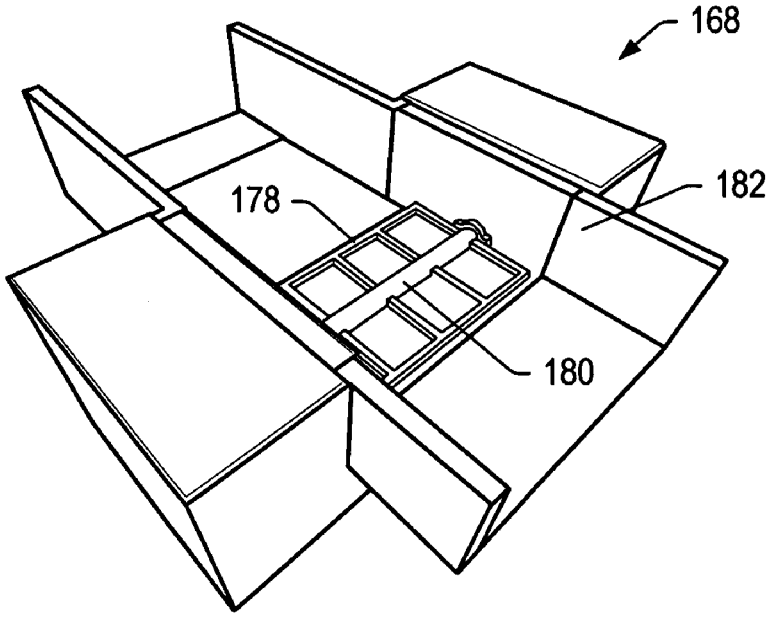
FIG. 34 depicts a perspective view of an embodiment of a portion of an adjustable weir in a portion of a water channel of an amusement ride.
Figure 35:
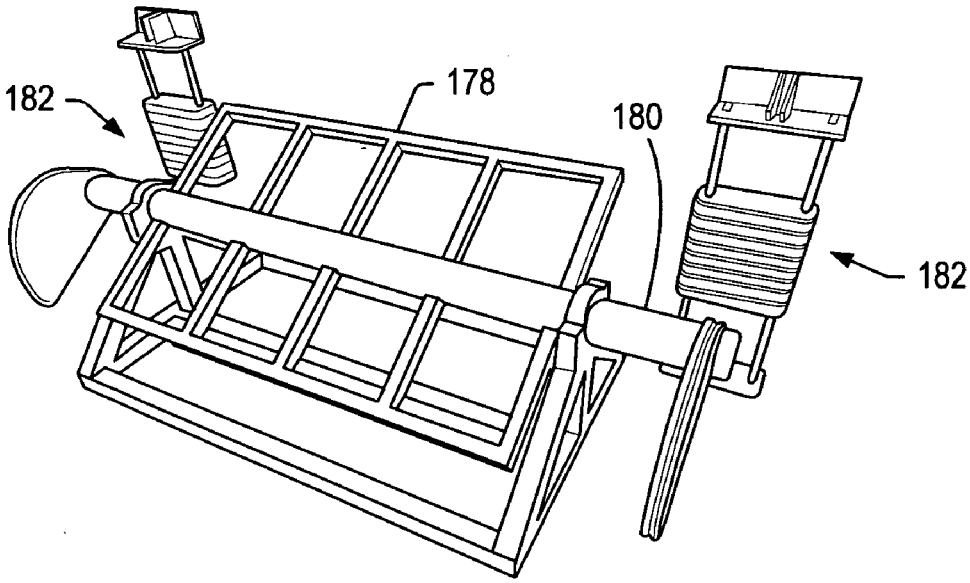
FIG. 35 depicts a perspective view of an embodiment of a portion of an adjustable weir.

FIG. 34 depicts a perspective view of an embodiment of a portion of adjustable weir 168 in a portion of a water channel of an amusement ride. FIG. 35 depicts a perspective view of an embodiment of a portion of adjustable weir 168. In adjustable weir embodiments including counterweight mechanisms, the outboard (adjustable) counterweights are, in the fully retracted position, fully dropped.

In certain embodiments, outboard pits may be covered—though size, shape, theming, etc., of such may be determined on an application basis.

FIG. 34 and FIG. 35 depict an embodiment of adjustable weir 168 including a counterweight mechanism system. With FRP/trim pieces removed, the mechanism includes a main structural frame 178, tilting weir table-shaft 180, and counterweight system 182.

As a variety of drive means may be applied, none are presented in the FIG. 34 and FIG. 35. Drive means may be installed in the outboard pit areas. Any drive means known to one skilled in the art may be used.

In this patent, certain U.S. patents, U.S. patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A system for conveying a participant from a first source of water to a second source of water in a water amusement park, comprising:

a belt configured to convey a participant and/or a participant vehicle, wherein the belt is coupled to the first source of water and to the second source of water;

a belt movement system, configured to move the belt in a loop; and one or more barriers coupled to the belt, wherein at least one of the barriers inhibits, during use, participants from leaving the belt as the participants are conveyed along the belt, wherein one or more of the barriers is at least partially positioned substantially above the belt, wherein one or more of the barriers is at least partially positioned substantially adjacent one or more sides of the belt, wherein one or more of the barriers comprises a substantially flexible material, and wherein at least a portion of one or more of the substantially flexible barriers coupled to the belt is positionable such that when the portion is in a first position at least a portion of the belt is accessible and when the portion of the substantially flexible barrier is in a second position the portion of the belt is substantially inaccessible.

2. The system of claim 1, wherein at least a portion of one or more of the barriers is configured such that the contours of the portion substantially complement the contours of at least a portion of the first source of water and/or the second source of water.

3. The system of claim 1, wherein one or more of the barriers are positioned substantially above the belt and comprises a substantially flexible material, and wherein one or more of the barriers are positioned adjacent one or more sides of the belt and comprise a substantially rigid material.

4. The system of claim 1, wherein one or more of the barriers are positioned adjacent a surface of the belt at a transfer point from or onto the belt, and wherein a surface of one or more of the barriers is compatible with the surface of the belt such that participants are inhibited from accessing an area below one or more of the barriers.

5. The system of claim 1, wherein at least a portion of one or more of the barriers are configured to provide shade for participants.

6. The system of claim 1, wherein at least one of the barriers comprises a net.

7. The system of claim 1, wherein at least one of the barriers comprises a net, and wherein the net comprises polymers.

8. The system of claim 1, wherein at least one of the barriers comprises a net, and wherein the net comprises metal.

9. The system of claim 1, wherein one or more of the barriers are configured to be removable.

10. The system of claim 1, wherein one or more of the barriers are configured to be removable allowing access to the belt, the belt movement system, and/or participants.

11. The system of claim 1, wherein the first source of water is at a different elevation than the second source of water.

12. The system of claim 1, wherein the first source of water is a channel.

13. The system of claim 1, wherein the second source of water is a slide.

14. The system of claim 1, wherein at least one barrier is positioned to cover the outer edges of the belt, wherein participants are inhibited from accessing the belt movement system by at least one barrier.

15. The system of claim 1, further comprising a plurality of support members coupled to the belt and to at least a portion of one or more of the substantially flexible barriers, wherein at least one of the support members supports and positions the portion of the substantially flexible barrier relative to the belt.

* * * * *

UNITED STATES PATENT AND TRADEMARK OFFICE

CERTIFICATE OF CORRECTION

PATENT NO. : 7,815,514 B2
APPLICATION NO. : 11/215736
DATED : October 19, 2010
INVENTOR(S) : Henry et al.

It is certified that error appears in the above-identified patent and that said Letters Patent is hereby corrected as shown below:

Title page, item [75] inventor delete "Jeffrey Wayne Henry" and substitute therefor -- Jeffery Wayne Henry --.

Signed and Sealed this
Eighteenth Day of January, 2011

David J. Kappos

David J. Kappos
*Director of the United States Patent and Trademark Office*